US010647470B2

(12) United States Patent
Robinson

(10) Patent No.: US 10,647,470 B2
(45) Date of Patent: May 12, 2020

(54) MODULAR PALLETS

(71) Applicant: William Stuart Robinson, Vancouver (CA)

(72) Inventor: William Stuart Robinson, Vancouver (CA)

( * ) Notice: Subject to any disclaimer, the term of this patent is extended or adjusted under 35 U.S.C. 154(b) by 0 days.

(21) Appl. No.: 15/719,339

(22) Filed: Sep. 28, 2017

(65) Prior Publication Data

US 2019/0092522 A1 Mar. 28, 2019

(51) Int. Cl.
*B65D 19/00* (2006.01)

(52) U.S. Cl.
CPC ..... *B65D 19/0093* (2013.01); *B65D 19/0026* (2013.01); *B65D 19/0081* (2013.01); *B65D 19/0095* (2013.01); *B65D 19/0097* (2013.01); *B65D 2519/00034* (2013.01); *B65D 2519/00039* (2013.01); *B65D 2519/00069* (2013.01); *B65D 2519/00074* (2013.01); *B65D 2519/00104* (2013.01); *B65D 2519/00109* (2013.01); *B65D 2519/00273* (2013.01); *B65D 2519/00288* (2013.01); *B65D 2519/00293* (2013.01); *B65D 2519/00298* (2013.01); *B65D 2519/00318* (2013.01); *B65D 2519/00323* (2013.01); *B65D 2519/00333* (2013.01); *B65D 2519/00338* (2013.01); *B65D 2519/00343* (2013.01); *B65D 2519/00353* (2013.01);
(Continued)

(58) Field of Classification Search
CPC ..... B65D 19/0093; B65D 19/0095; B65D 19/0053; B65D 19/0067; B65D 19/0073; B65D 19/0077; B65D 19/0089
USPC ..... 108/56.1, 57.17, 57.19
See application file for complete search history.

(56) References Cited

U.S. PATENT DOCUMENTS

D231,091 S 4/1974 Wilson
D231,096 S 4/1974 Adam
(Continued)

FOREIGN PATENT DOCUMENTS

CN 105416766 A 6/2016
CN 105711930 A 6/2016
(Continued)

*Primary Examiner* — Daniel J Rohrhoff
(74) *Attorney, Agent, or Firm* — Oyen Wiggs Green & Mutala LLP

(57) ABSTRACT

A modular pallet formed from a plurality of frame members and a plurality of deck members. The deck members extend between the frame members to define an upper deck surface and optionally a lower deck surface of the pallet. A plurality of spaced-apart channels are formed in at least an upper surface of the frame members to receive the deck members. In some embodiments the pallet may be configured as a stringer pallet and in other embodiments the pallet may be configured as a block pallet. In some embodiments the frame members are unitary stringers. In other embodiments the frame members are modular structures each comprising a block pallet subassembly and a deck support panel. The number, size, orientation and spacing of the channels formed in the frame members and the corresponding arrangement of the deck members may vary in different embodiments of the pallet. Once assembled, the frame members and deck members may be integrally connected, such as by heat welding. In some embodiments the pallet is formed from readily recyclable plastic.

53 Claims, 28 Drawing Sheets

(52) U.S. Cl.
CPC ..... *B65D 2519/00373* (2013.01); *B65D 2519/00562* (2013.01); *B65D 2519/00567* (2013.01)

(56) References Cited

U.S. PATENT DOCUMENTS

| | | | | |
|---|---|---|---|---|
| D231,653 | S | 5/1974 | Schell | |
| 3,861,326 | A | 1/1975 | Brown | |
| 3,878,796 | A * | 4/1975 | Morrison | B65D 19/0075 108/56.1 |
| 4,220,099 | A * | 9/1980 | Marchesano | B65D 19/0069 108/57.1 |
| D267,386 | S | 12/1982 | Kneale | |
| D291,935 | S | 9/1987 | Nordstrom | |
| D316,319 | S | 4/1991 | Bathon | |
| D331,470 | S | 12/1992 | Mitchell | |
| D335,743 | S | 5/1993 | Nordstrom | |
| 5,440,998 | A | 8/1995 | Morgan, IV et al. | |
| 5,879,495 | A * | 3/1999 | Evans | B29C 66/02 156/153 |
| 6,216,608 | B1 * | 4/2001 | Woods | B65D 19/0012 108/56.1 |
| D645,634 | S | 9/2011 | Moore | |
| D645,635 | S | 9/2011 | Moore | |
| 2004/0000259 | A1 * | 1/2004 | Taft | B65D 19/0073 108/57.25 |
| 2006/0096508 | A1 * | 5/2006 | Herring | B65D 19/0095 108/54.1 |
| 2008/0066657 | A1 * | 3/2008 | Kuo | B65D 19/0095 108/57.19 |
| 2012/0132114 | A1 * | 5/2012 | Krupka | B65D 19/0095 108/57.25 |
| 2012/0298015 | A1 * | 11/2012 | Jian | B65D 19/0097 108/56.1 |
| 2014/0174327 | A1 * | 6/2014 | Whiteford | B65D 19/0095 108/50.11 |
| 2014/0251188 | A1 * | 9/2014 | Jordan | B65D 19/0012 108/51.3 |
| 2015/0122160 | A1 * | 5/2015 | Frautschi | B65D 19/0012 108/51.3 |
| 2015/0321792 | A1 * | 11/2015 | Joung | B65D 19/38 108/57.25 |
| 2016/0207663 | A1 * | 7/2016 | Pisano | B65D 19/0095 |
| 2018/0162588 | A1 * | 6/2018 | Segerstrom | B65D 19/38 |

FOREIGN PATENT DOCUMENTS

| | | |
|---|---|---|
| EP | 2407391 | 1/2012 |
| WO | 9521093 A1 | 8/1995 |

* cited by examiner

MODULAR PALLETS

TECHNICAL FIELD

This application relates to modular pallets, such as pallets constructed from recyclable plastic components.

BACKGROUND

Pallets are commonly used for storing and transporting goods. The vast majority of pallets in commercial use (approximately 95%) are constructed of wood. While wood pallets are in common use they have various shortcomings. Most wood pallets are transported in assembled form and not constructed from modular components. Wood pallets are relatively heavy, typically on the order of approximately 35 to 50 pounds for a standard size unit. This can significantly increase transportation costs. Also, wood pallets are susceptible to bacterial and chemical contamination and insect infestation which make them unsuitable for some applications. They have a limited useful life and are often discarded as trash along with product wrapping materials and the like.

Pallets constructed from plastic are known in the prior art. Plastic pallets are considerably more durable than wood pallets and may outlast wood pallets by four years or more. Plastic pallets effectively resist chemicals, splintering and rot. Other benefits of plastic pallets include fire retardancy, resistance to odour and the ability to be easily sanitized. The primary drawback to widespread adoption of plastic pallets is cost: plastic pallets can cost ten times or more than wood pallets.

Some lightweight plastic pallets are in use that are formed in a unitary mold. Such pallets are expensive to manufacture and ship and cannot be easily disassembled and recycled after their useful life.

Plastic pallets formed from separate modules or components are also known. For example, European patent publication EP 2407391 published 18 Jan. 2012 discloses a modular and multidimensional plastic pallet comprising individual pieces which can be fitted together using a mortise arrangement without the use of welds. This enables individual plastic pieces to be easily dismantled and replaced.

U.S. Pat. No. 5,440,998 dated 15 Aug. 1995 similarly discloses a plastic pallet assembly and method having corrugated deckboards which are designed to be releasably fastened to pallet stringers. Thus the deckboards and stringers are not integrally connected together after assembly.

U.S. Pat. No. 3,878,796 dated 22 Apr. 1975 discloses a knock-down plastic pallet assembly comprising stringers and deck boards which are held in an interlocked relationship by an arrangement of notches and shoulders.

The modular pallets known in the prior art suffer from the disadvantage that they are relatively expensive to manufacture and ship, are formed from an excessive number or size of plastic components, are not readily recyclable and/or are optimized for easy disassembly rather than superior durability and load-carrying characteristics. The need has therefore arisen for improved modular pallets capable of overcoming at least some of the limitations of the prior art.

The foregoing examples of the related art and limitations related thereto are intended to be illustrative and not exclusive. Other limitations of the related art will become apparent to those of skill in the art upon a reading of the specification and a study of the drawings.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

In one aspect there is provided a modular pallet comprising a plurality of elongated frame members arranged in spaced-apart relation, wherein each of the frame members comprises an upper surface and a lower surface and wherein at least the upper surface has a plurality of spaced-apart channels formed therein; and a plurality of elongated deck members positionable in the channels for coupling the frame members together. In some embodiments each frame member may comprise a unitary stringer. In other embodiments each frame member may comprise a block pallet subassembly comprising a plurality of blocks and at least one block connector. In some embodiments a deck support panel comprising the spaced-apart channels may be positioned on each block pallet subassembly.

In another aspect a kit for forming a pallet is provided comprising a plurality of elongated frame members positionable in spaced-apart relation each comprising an upper surface and a lower surface, wherein at least the upper surface has a plurality of spaced-apart channels formed therein; and a plurality of elongated deck members positionable within the channels for coupling the frame members together.

In another aspect a method of forming a pallet is provided comprising providing a kit as described above; arranging the frame members in spaced-apart relation such that the channels in corresponding ones of the frame members are aligned; inserting the deck members within the channels such that the deck members extend to connect the frame members together; and integrally connecting the deck members to the frame members. In some embodiments the frame members and the deck members are formed from plastic and the connecting comprises heat welding the deck members to the frame members.

In addition to the exemplary aspects and embodiments described above, further aspects and embodiments will become apparent by reference to the drawings and by study of the following detailed descriptions.

BRIEF DESCRIPTION OF THE DRAWINGS

Exemplary embodiments are illustrated in referenced figures of the drawings. It is intended that the embodiments and figures disclosed herein are to be considered illustrative rather than restrictive.

DESCRIPTION

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

Figure 1:
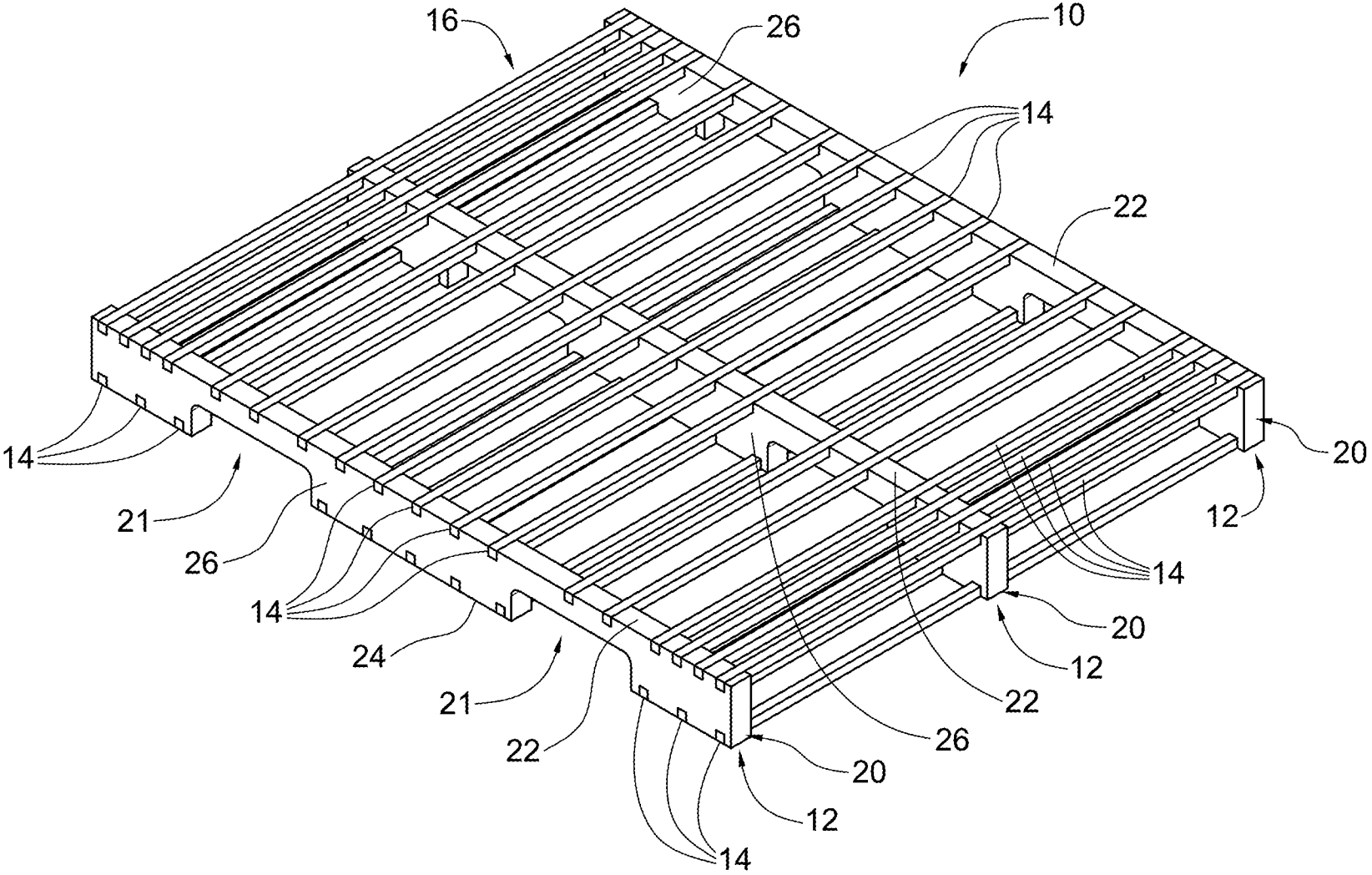
FIG. 1 is a top isometric view of an embodiment of an assembled pallet configured as a stringer pallet.
Figure 2:
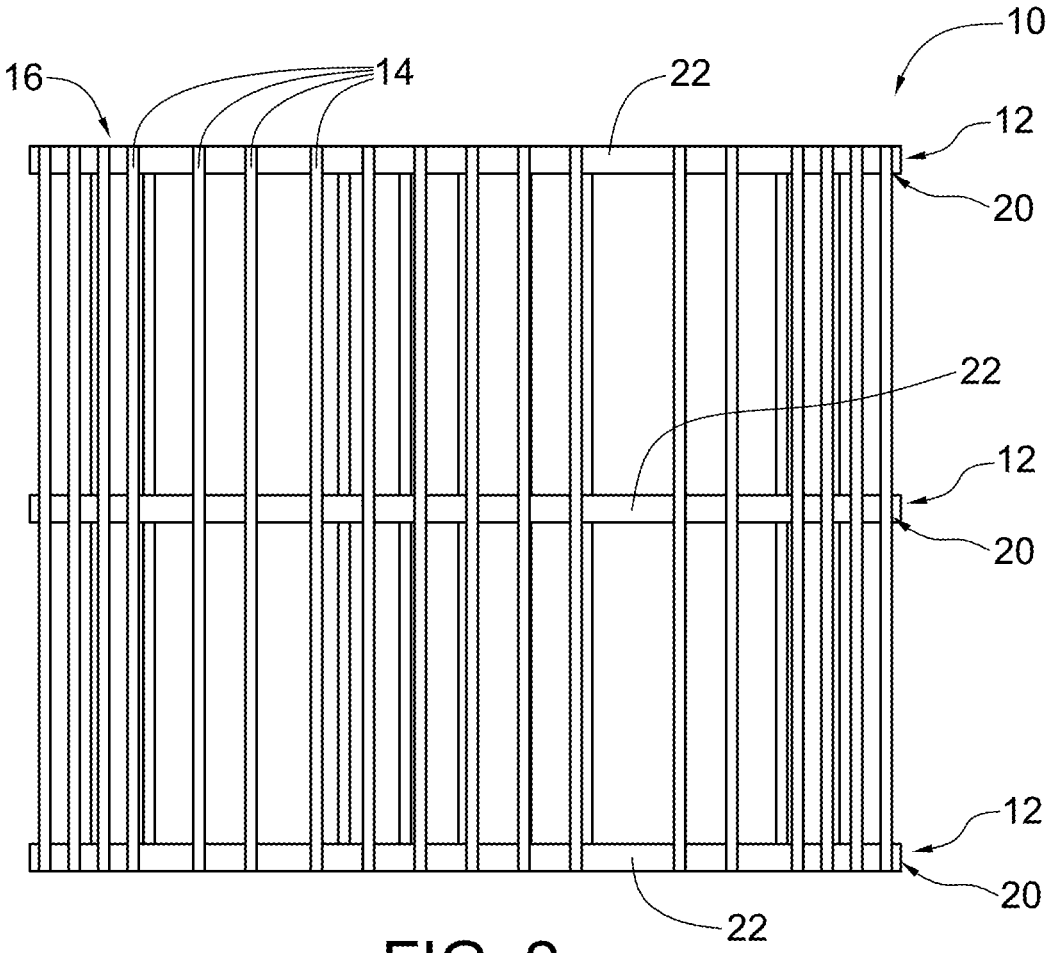
FIG. 2 is a top plan view of the pallet of FIG. 1.
Figure 3:
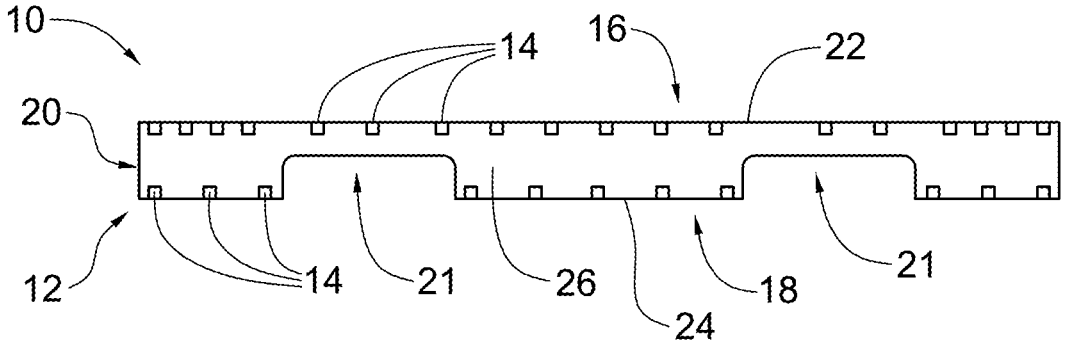
FIG. 3 is a side elevational view of the pallet of FIG. 1.
Figure 4:
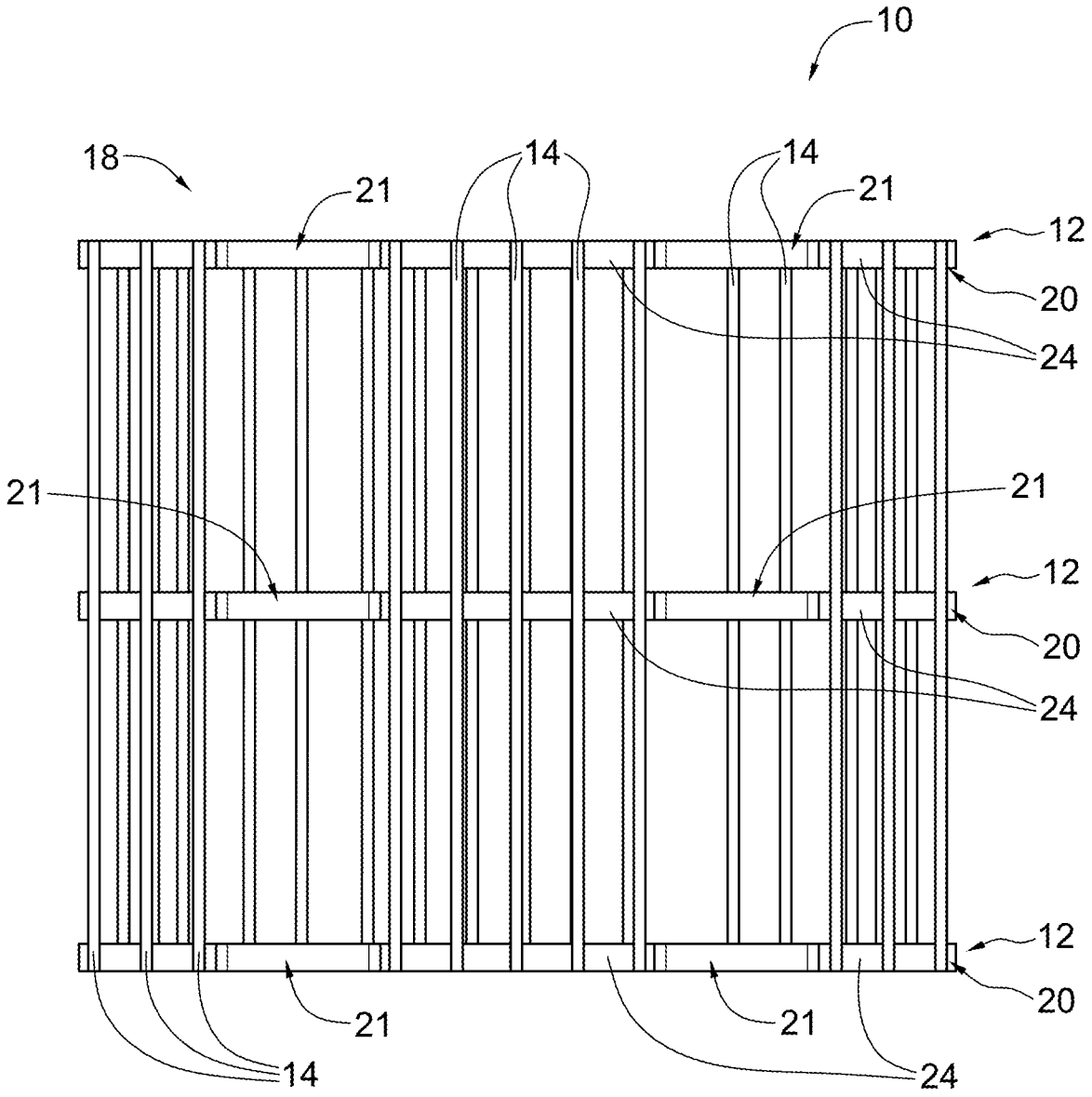
FIG. 4 is a bottom plan view of the pallet of FIG. 1.
Figure 5:
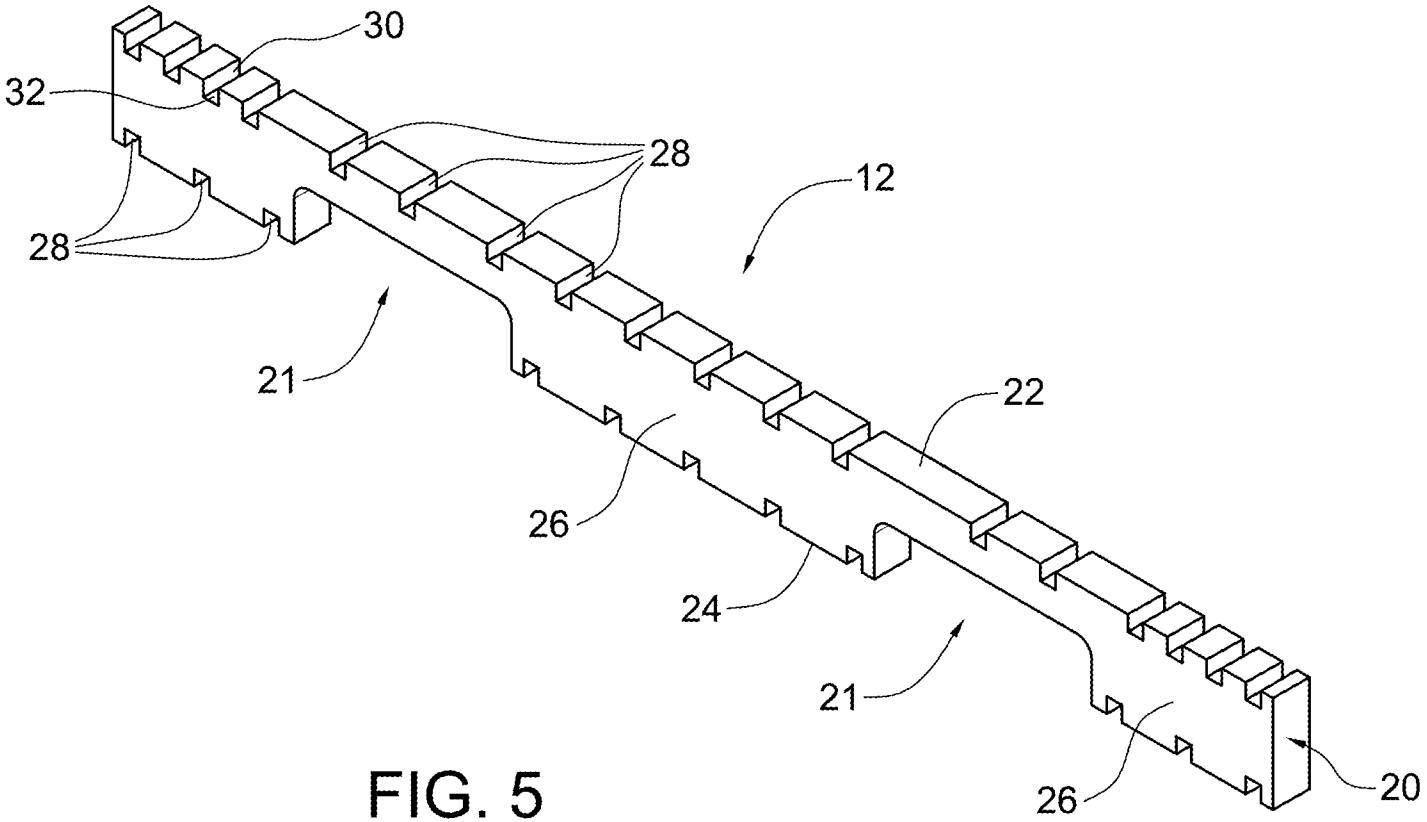
FIG. 5 is a top isometric view of an embodiment of a pallet stringer.
Figure 6:
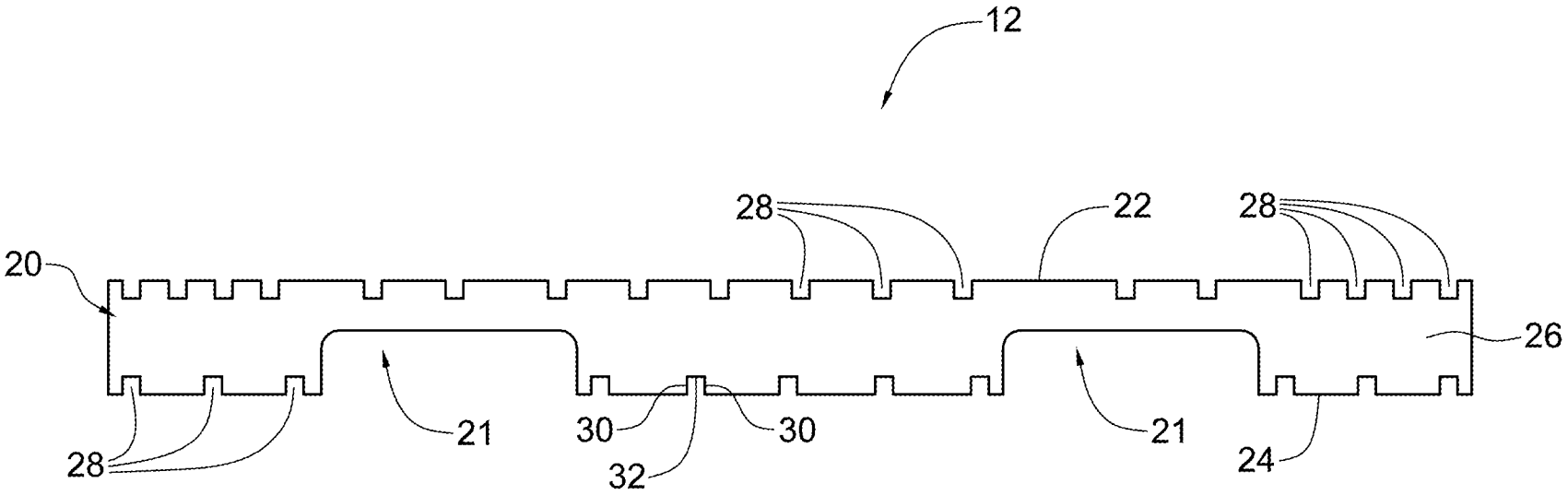
FIG. 6 is a side elevational view of the stringer of FIG. 5.
Figure 7:
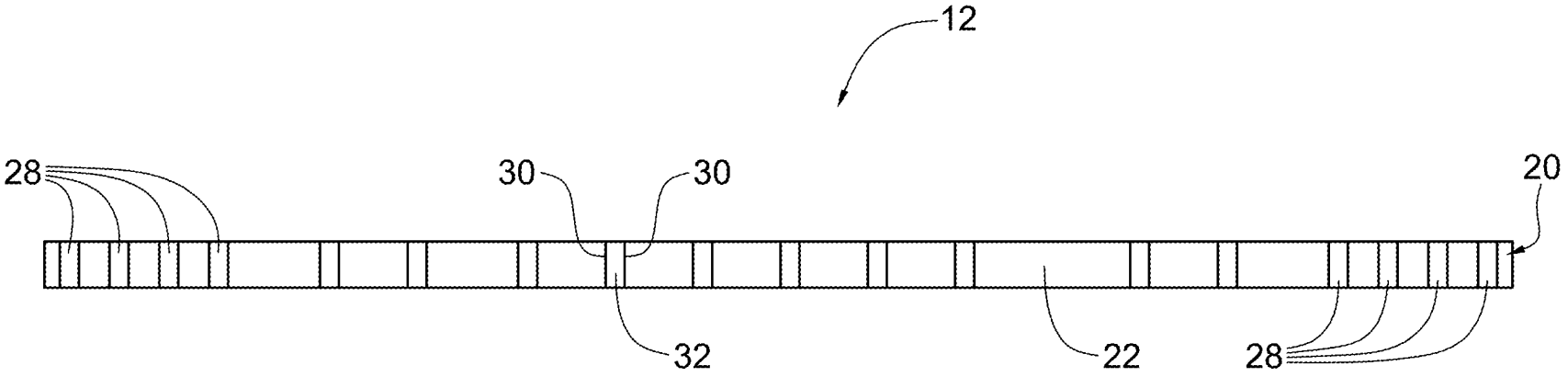
FIG. 7 is a top plan view of the stringer of FIG. 5.
Figure 9:
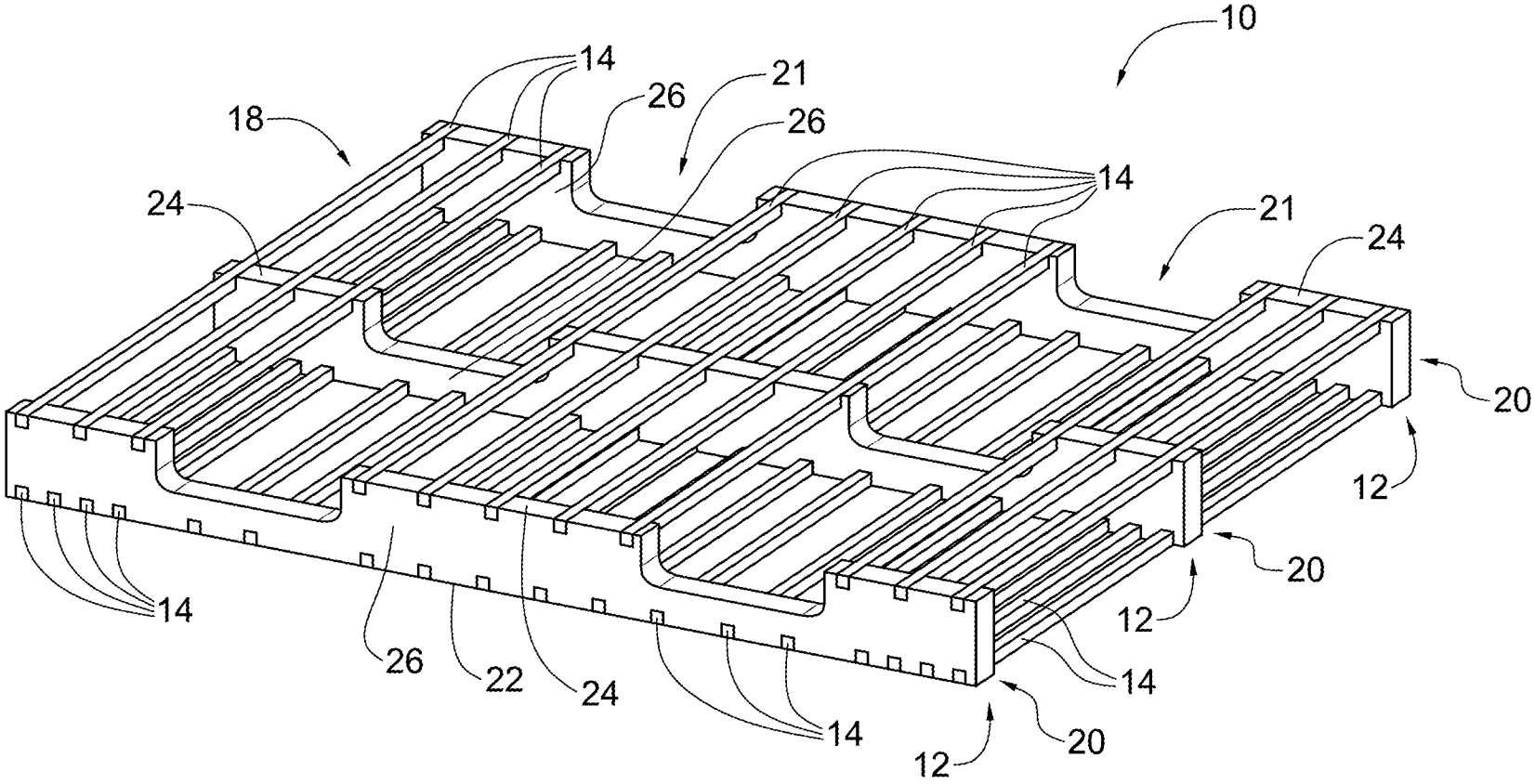
FIG. 9 is a bottom isometric view of the pallet of FIG. 1
Figure 10:
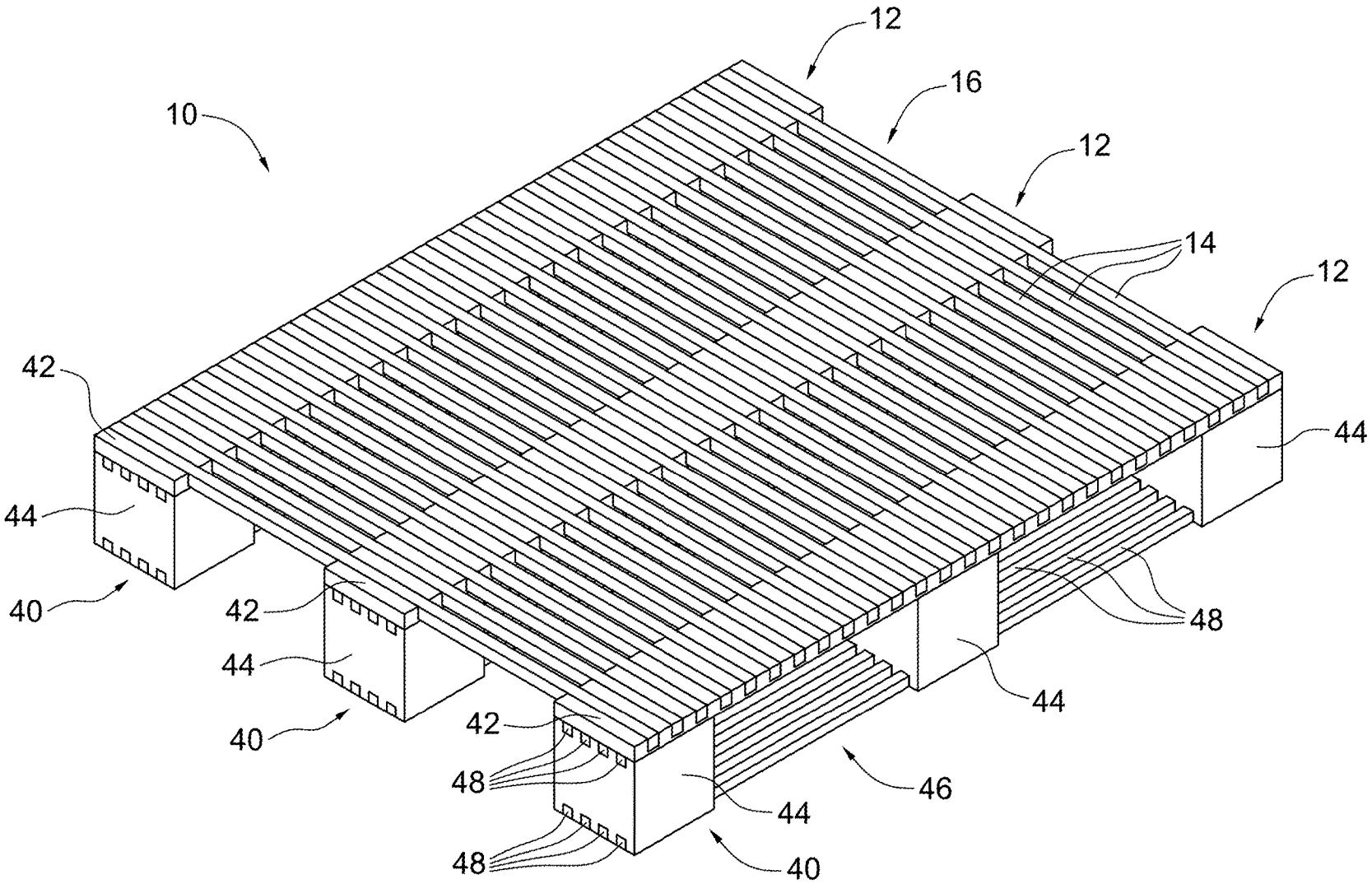
FIG. 10 is a top isometric view of an embodiment of an assembled pallet configured as a block pallet.

This application relates to a pallet 10 formed from modular components. In some embodiments pallet 10 is assembled from a plurality of frame members 12 and a plurality of deck members 14. With reference to FIG. 1, frame members 12 may be arranged in spaced-apart, parallel relation. Deck members 14 extend transversely between frame members 12 to define an upper deck surface 16. Optionally deck members 14 may also form a lower deck surface 18 (FIGS. 3 and 9).

In embodiments configured as a stringer pallet 10 each frame member 12 may comprise a unitary stringer 20 (FIGS. 1-9). In embodiments configured as a block pallet 10 each frame member 12 may comprise a block pallet subassembly 40 comprising a plurality of blocks 44 coupled together by at least one block connector 46, and a deck support panel 42 postionable on or forming part of block pallet subassembly 40 (FIGS. 10-29).

In the embodiment of FIGS. 1-9, each stringer 20 has spaced openings 21 formed therein to enable transverse insertion of a forklift forks, ground lifts or the like between upper deck surface 16 and lower deck surface 18. Optionally, pallet 10 may also be handled by inserting a forklift fork longitudinally between parallel stringers 20. Thus, in this embodiment pallet 10 is a "four-way" pallet which can be loaded from four separate directions.

In the embodiment of FIGS. 1-9 each stringer 20 comprises an upper surface 22, a lower surface 24 and side surfaces 26 extending between upper and lower surfaces 22, 24. A plurality of spaced-apart transverse channels 28 are formed in upper surface 22 and optionally lower surface 24. As shown best in FIGS. 5-7, each channel 28 is defined by side surfaces 30 and an inner surface 32 extending therebetween. In the illustrated embodiment, each channel 28 is rectangular in shape and is configured to receive a corresponding rectangular portion of a deck member 14. In the other embodiments channels 28 and deck member 14 may have other mating shapes and sizes.

Figure 8:
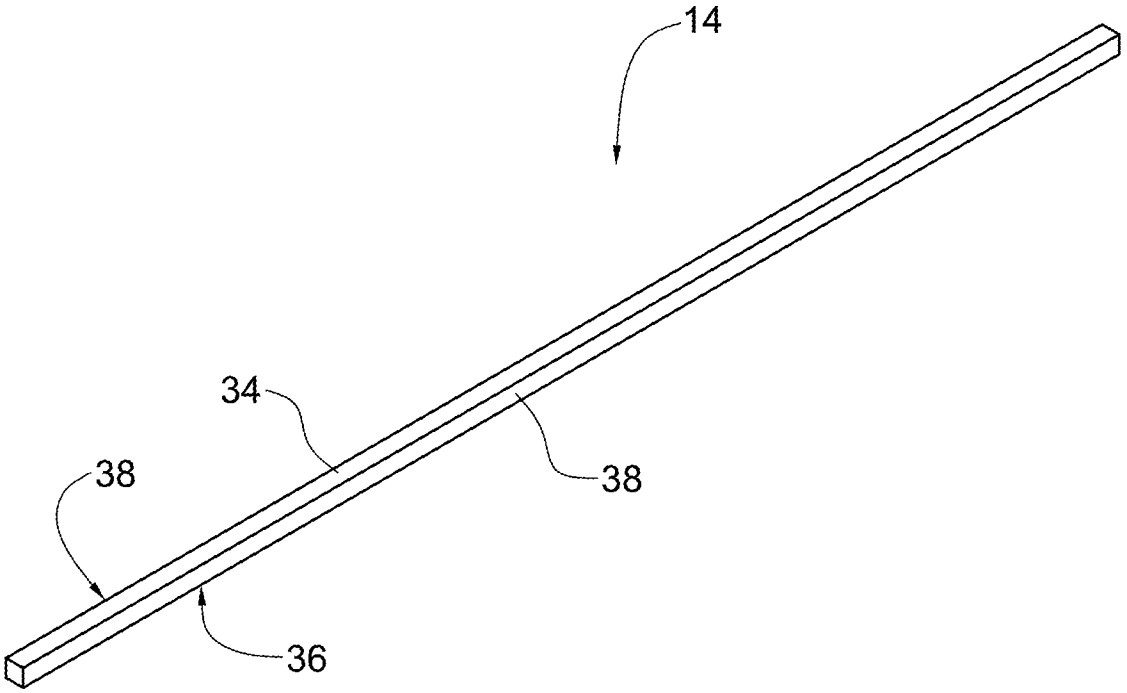
FIG. 8 is an enlarged, top isometric view of an embodiment of a deck member.

As best shown in FIG. 8, each deck member 14 has an outer surface 34, an inner surface 36 and side surfaces 38 extending therebetween. The depth of each channel 28 is approximately equal to the height of each deck member 14, i.e. the distance between outer and inner surfaces 34, 36. Thus, when deck members 14 are inserted into aligned channels 28 in stringers 12 as shown in FIG. 1, inner surface 36 of each deck member contacts an inner surface 32 of a corresponding channel 28 and outer surface 36 of each deck member 14 extends substantially flush with either an upper surface 22 or lower surface 24 of each stringer 20, thereby forming planar upper deck surface 16 or lower deck surface 18 (FIG. 3).

In some embodiments the size of channels 28 may vary to accommodate deck members 14 of different sizes. For example, comparatively larger channels 28 may be formed at end portions of each stringer 12 to receive comparatively larger, lead deck members 14. In other embodiments the size of channels 28 may be uniform for receiving deck members 14 of correspondingly uniform size.

The spacing between channels 28 may be uniform or may vary. In the illustrated embodiment of FIG. 1, channels 28 formed at end portions of stringer 20 are uniform in size but are more closely spaced together than channels 28 formed in intermediate portions of stringers 20. As a result, a comparatively larger number of deck members 14 of uniform size can be deployed in this embodiment at end portions of pallet 10 to provide enhanced torsional rigidity and strength.

In other embodiments channels 28 may be uniformly spaced along the length of each stringer 20 such that deck members 14 are also uniformly spaced.

As is apparent from the embodiment of FIGS. 1-9, the number of channels 28 formed in upper surface 22 of each stringer 20 may exceed the number of channels 28 formed in lower surface 24 of each stringer 20. Accordingly, the number of deck members 14 forming upper deck surface 16 may exceed the number of deck members 14 forming lower deck surface 18. In use, most of the load-carrying capacity of pallet 10 is provided by upper deck surface 16 and lower deck surface 18 may be principally provided to maintain the torsional rigidity and strength of pallet 10.

In some embodiments the width of channels 28 and the corresponding width of deck members 14 may vary between about ¼ inches and about 10 inches. In particular embodiments the width of channels 28 and deck members 14 may be less than about 10 inches, or 8 inches, or 6 inches, or 4 inches, or 2 inches, or 1 inch.

The weight of pallet 10 may vary depending on the overall dimensions of pallet 10 and the size and number of deck members 14. In some embodiments the overall weight of pallet 10 may be less than about 50 pounds, or 40 pounds, or 30 pounds, or 25 pounds, or 20 pounds, or 15 pounds, or 10 pounds.

In one exemplary embodiment shown in FIG. 1, pallet 10 is constructed from three identical stringers 20 and twenty-nine identical deck members 14. In this example upper deck surface 16 comprises eighteen deck members 14 and lower deck surface 18 comprises eleven deck members 14. In this example each stringer 20 is 48 inches in length, 1.5 inches in width and 4 inches in height. Each deck member 14 is 40 inches in length, ⅝ inches in width and ⅝ inches in height. The overall surface area of each deck surface 16, 18 is 40 inches by 48 inches or 1920 square inches. The portion of deck surfaces 16, 18 which comprises load-supporting surfaces of stringers 20 and/or deck members 14 is calculated as follows:

Load-supporting surface area of upper deck surface 16=3(*x*)+18(*y*)

where x=48×1.5 inches−(⅝×1.5 (18)) and y=40×⅝

Load-supporting surface of lower deck surface 18=3 (*x*)+11(*y*)

where x=48×1.5 inches−((⅝×1.5 (11))−2 (1.5(z)) where z equals the width of each opening 21 and y=40×⅝

According to these calculations the load-supporting surface area of upper deck surface 16 in this example is 615.375 square inches or approximately 32% of the overall surface area of deck surface 16. The load-supporting surface area of the deck surface 18 is 379.0625 square inches or approximately 20% of the overall surface area of deck surface 18.

Thus, in this example upper surfaces 22 of stringers 20 and outer surfaces 34 of deck members 14 make up approximately 32% of the overall surface area of upper deck surface 16. Similarly, in this example lower surfaces 24 of stringers 12 and outer surfaces 34 of deck members 14 make up approximately 20% of the overall surface area of lower deck surface 18.

For comparison purposes, a conventional wood pallet which is 48×40 inches in size comprises three stringers and, on its uppers deck surface, six 40×4 inch deck members and two 40×6 inch deck members. On its lower surface such a conventional wood pallet comprises four 40×4 inch deck members and two 40×6 inch deck members. Thus, in such a conventional wood pallet the load-supporting surfaces of the upper deck members comprise 1440 square inches or approximately 75% of the overall surface area of the upper deck surface. The load-supporting surfaces of the lower deck members comprise 1120 square inches or approximately 58% of the overall surface area of the lower deck surface. As will be appreciated by a person skilled in the art, in a conventional wood pallet the deck members are mounted overlying the outer surfaces of the stringers and hence the outer surfaces of the stringers do not form part of the deck support surface in a conventional pallet.

In some embodiments pallet 10 may be configured so that deck members 14 comprise less than about 60% of the overall surface area of deck surface 16. In other particular embodiments deck members 14 may comprise less than about 50% or 35% of the overall surface area of deck surface 16.

Unlike some prior art plastic pallets, in some embodiments pallet 10 generally resembles conventional wood pallets in size and appearance which may aid in its commercial adoption. However, it is apparent from the foregoing examples that in the exemplary embodiment pallet 10 may be constructed from considerably less material (less than half) than a conventional wood pallet. This may result in a pallet 10 which is considerably lighter and hence easier and less expensive to handle than a conventional wood pallet while maintaining sufficient torsional rigidity and strength characteristics to support comparable static and dynamic loads. Pallet 10 of this example also uses considerably less material than many prior art plastic pallets, similarly resulting in commercially significant cost savings.

In use, pallet 10 of the embodiment of FIGS. 1-9 may be constructed from an assembly of separate component parts. In particular, pallet 10 may be constructed by arranging stringers 20 in parallel, spaced-apart relation as shown in FIG. 1 and placing each deck member 14 within a subgroup of aligned channels 28 in stringers 20. That is, in this example each deck member 14 is inserted into a channel 28 of each one of stringers 20 to couple stringers 20 together (FIG. 1). Deck members 14 are sized and configured to fit snugly within channels 28 as described above. Once in place, deck members 14 may be integrally fused to stringers 20 by heat welding, by using adhesive, or by some other suitable method.

FIGS. 10-29 illustrate embodiments of pallet 10 configured as a block pallet. In some embodiments each frame member 12 may comprise a block pallet subassembly 40 and a deck support panel 42. As described further below, each panel 42 comprises a plurality of spaced-apart channels 28 for receiving deck members 14.

Figure 11:
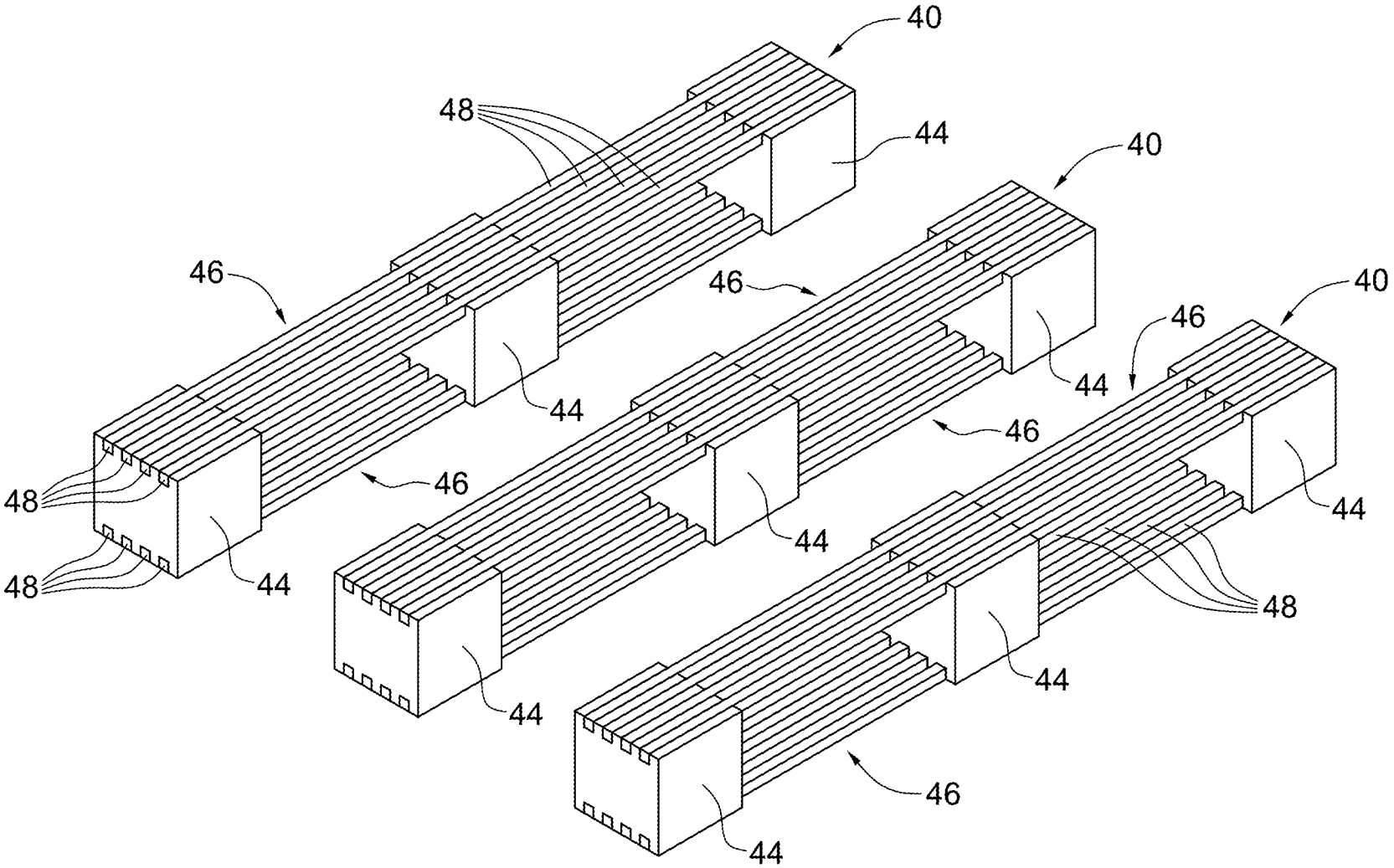
FIG. 11 is a top isometric view showing three block pallet subassemblies arranged in parallel, spaced-apart relation.
Figure 12:
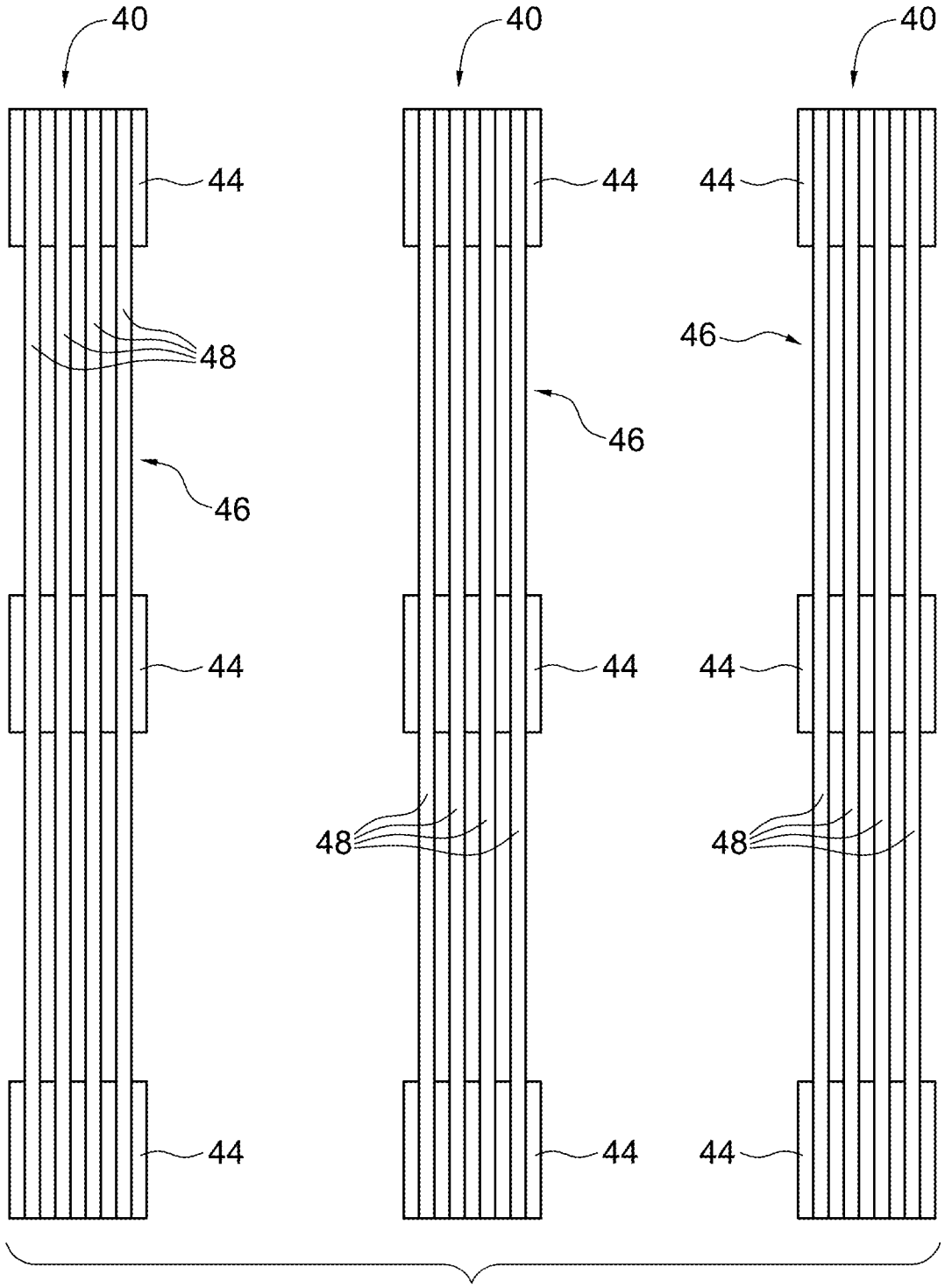
FIG. 12 is a top plan view of the subassemblies of FIG. 11.
Figure 13:
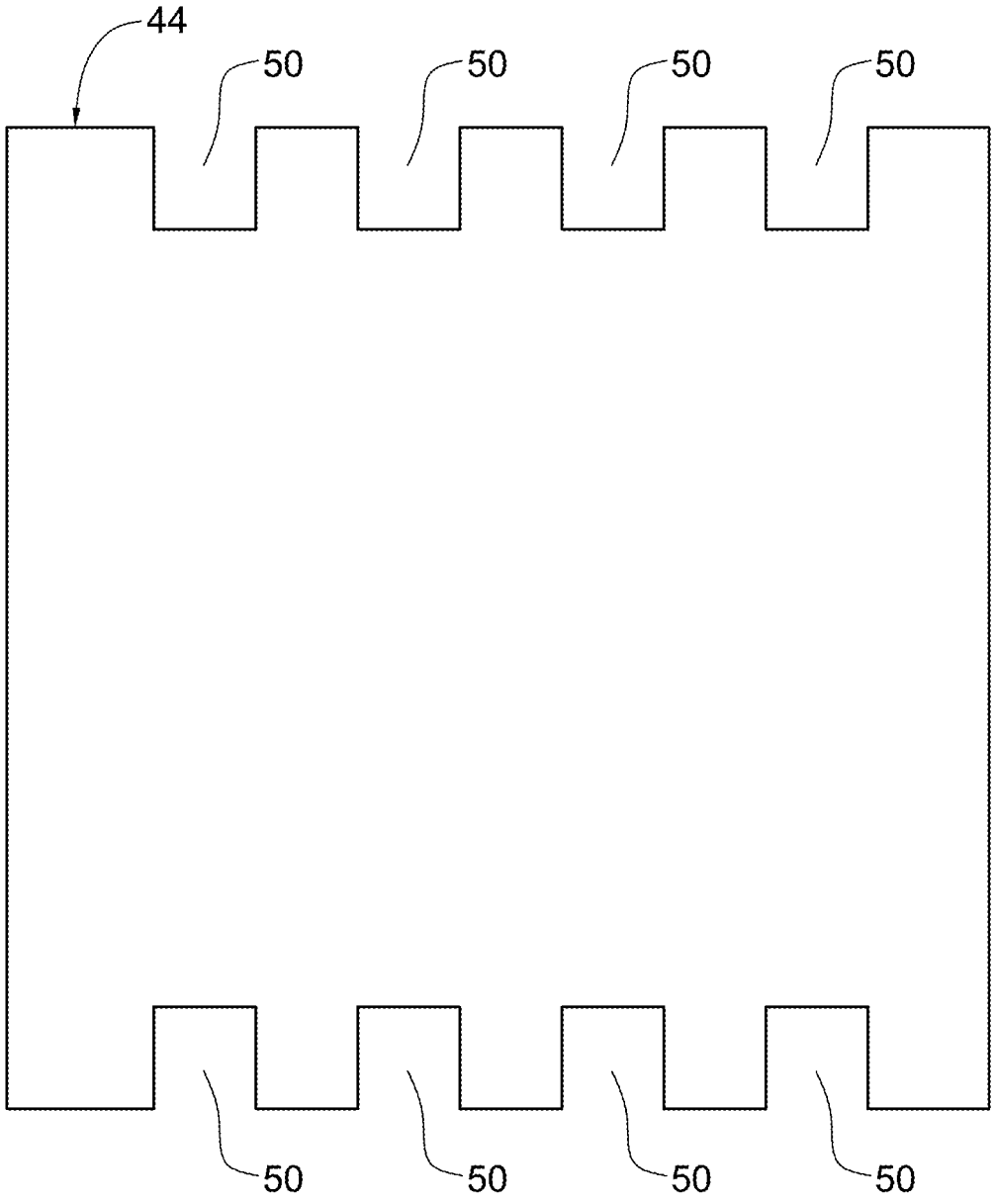
FIG. 13 is an enlarged, side elevational view of a slotted block of a block pallet subassembly of FIG. 11.
Figure 14:
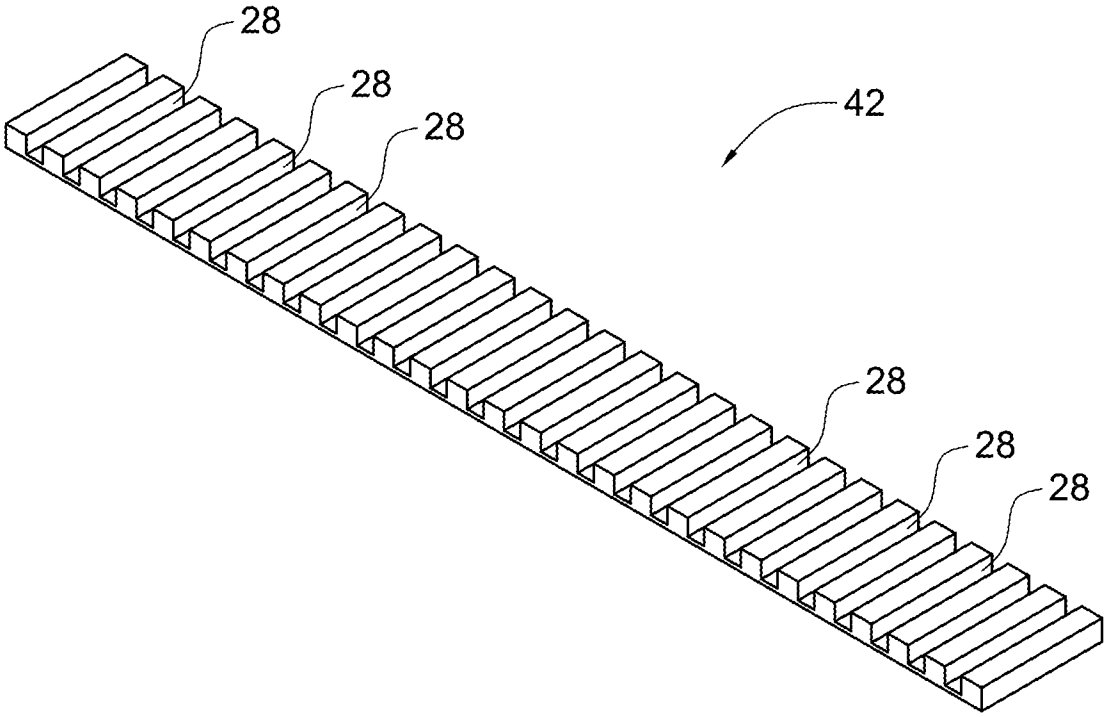
FIG. 14 is a top isometric view of a deck support panel for use with a block pallet subassembly.
Figure 15:
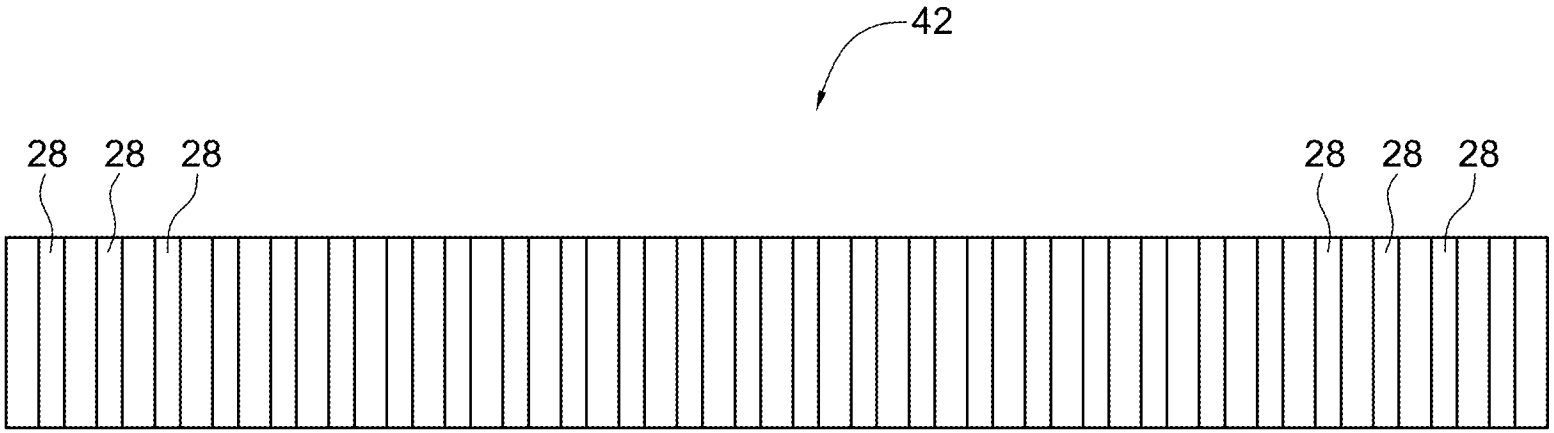
FIG. 15 is top plan view of the deck support panel of FIG. 14.
Figure 16:
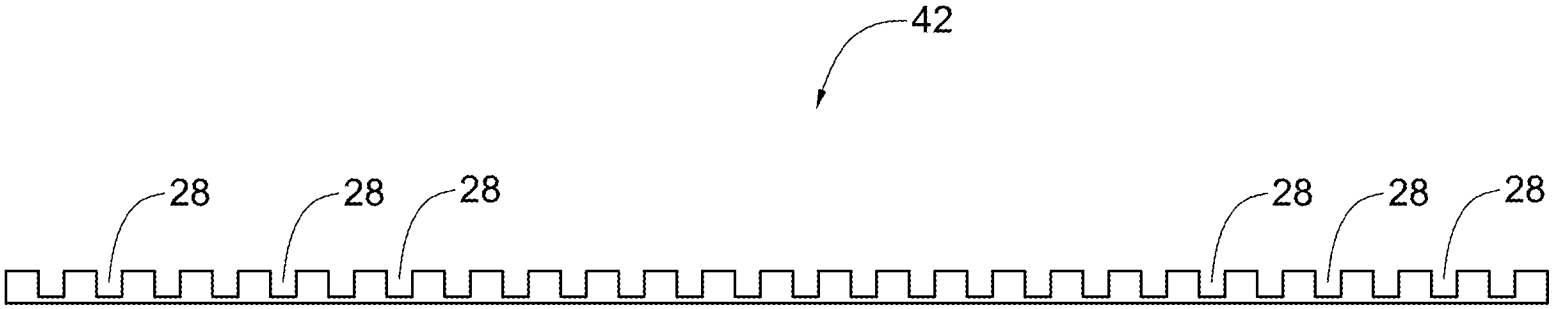
FIG. 16 is a side elevational view of the deck support panel of FIG. 14.
Figure 23:
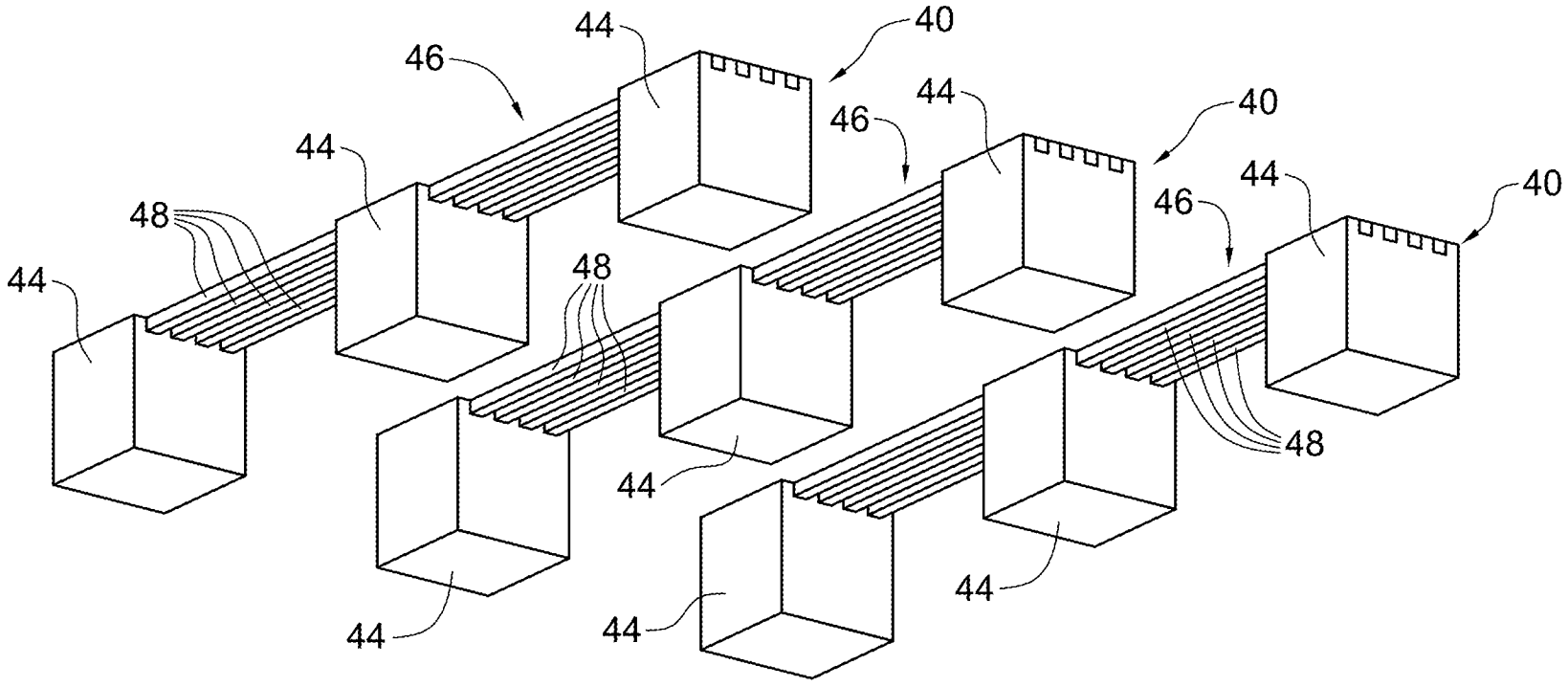
FIG. 23 is a bottom isometric view showing three block pallet subassemblies arranged in parallel, spaced-apart relation.
Figure 24:
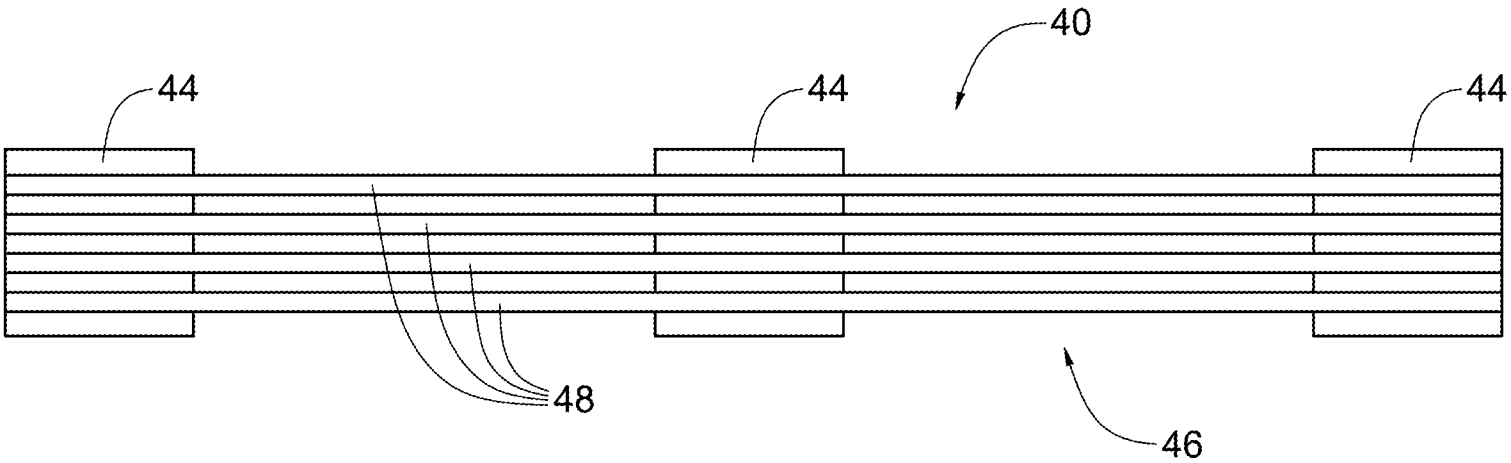
FIG. 24 is a top plan view of a subassembly of FIG. 23.
Figure 25:
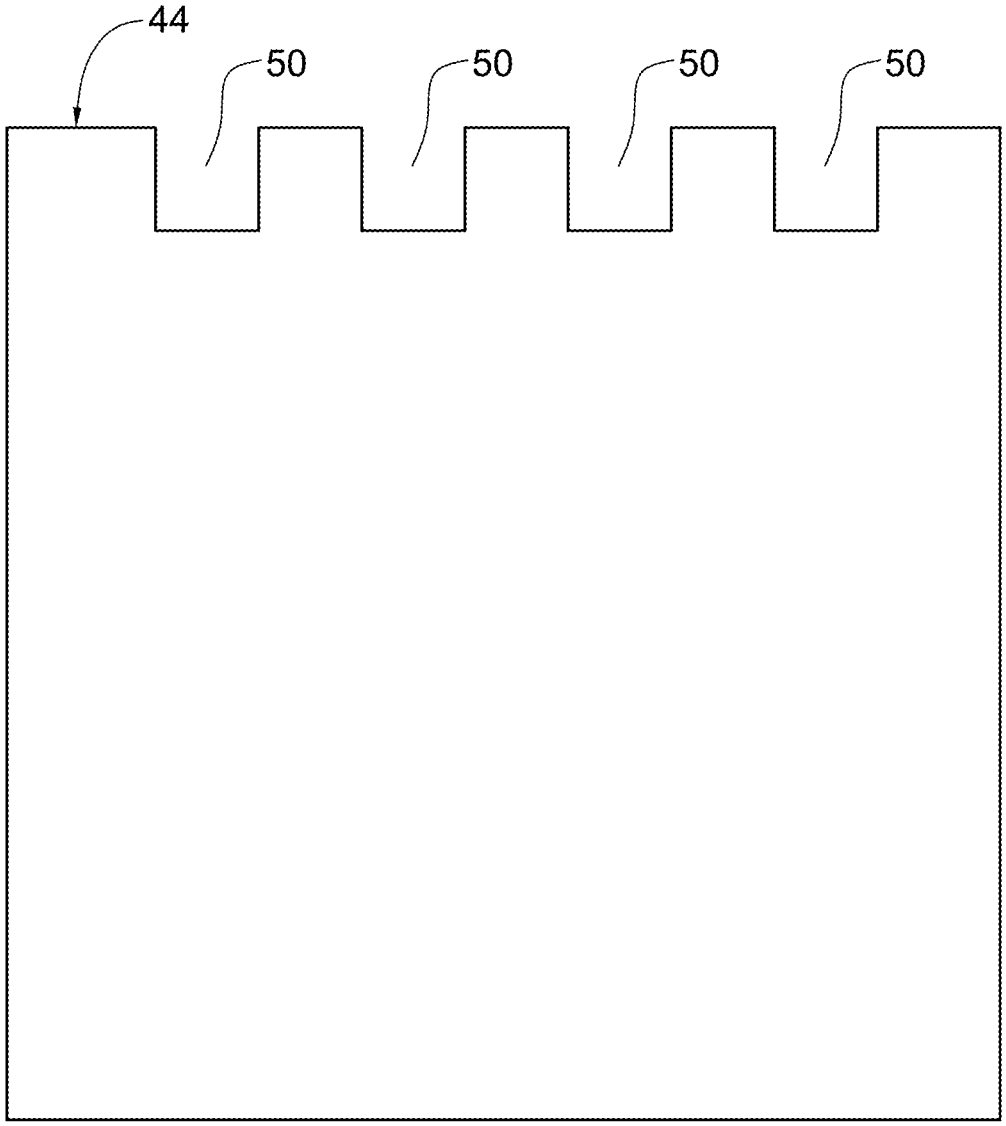
FIG. 25 is an enlarged, side elevational view of a slotted block of a subassembly of FIG. 23.

As shown best in FIGS. 11 and 23, each block pallet subassembly 40 comprises a plurality of blocks 44 and at least one block connector 46 for connecting blocks 44. FIG. 11 illustrates an embodiment with two block connectors 46 respectively coupling upper and lower portions of blocks 44. FIG. 23 illustrates an embodiment with one block connector 46 coupling upper portions of blocks 44. In some embodiments each block connector 46 may comprise a unitary connector or "stringer board" for coupling blocks 44 together. In other embodiments each block connector 46 may comprise a plurality of stringer members 48 each positionable within a corresponding slot 50 formed in blocks 44. FIG. 13 illustrates a block 44 with both upper and lower slots 50 for receiving stringer members 48. FIG. 25 illustrates an embodiment of block 44 having slots 50 formed in an upper portion of block 44 only for receiving stringer members 48.

When stringer members 48 are positioned within slots 50 and are secured in place, for example by heat welding or adhesives, they define an upper and/or lower planar surface for receiving a deck support panel 42 or for supporting pallet 10 on a support surface. Stringer members 48 also provide each block pallet subassembly 40 and hence each frame member 12 with torsional rigidity.

Figure 17:
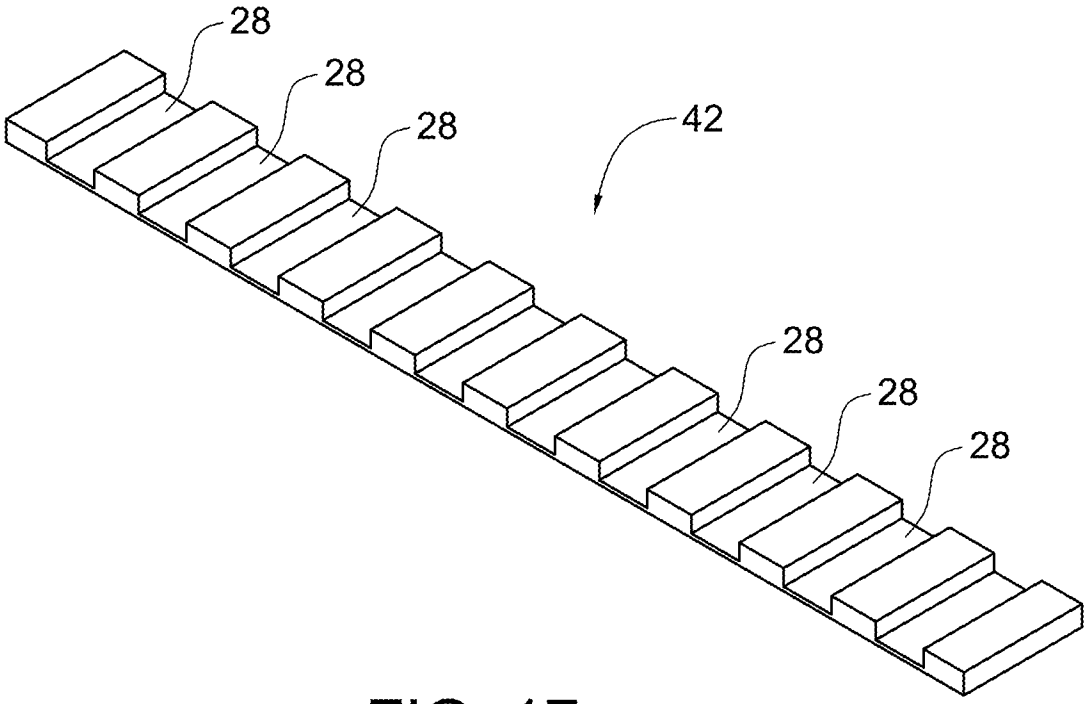
FIG. 17 is a top isometric view of another embodiment of a deck support panel.
Figure 18:
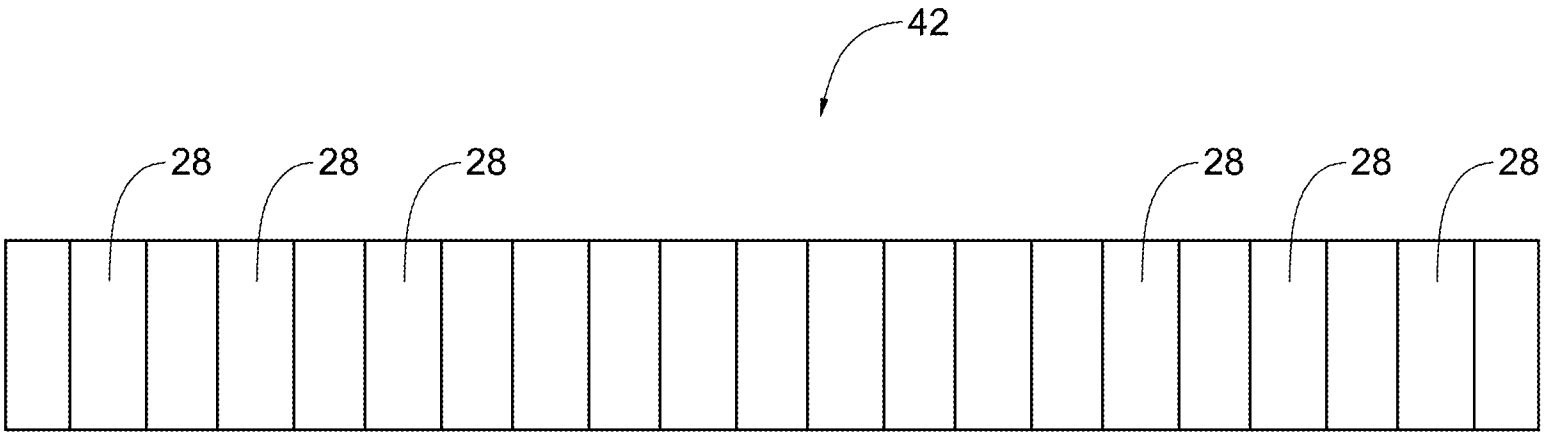
FIG. 18 is top plan view of the deck support panel of FIG. 17.
Figure 19:
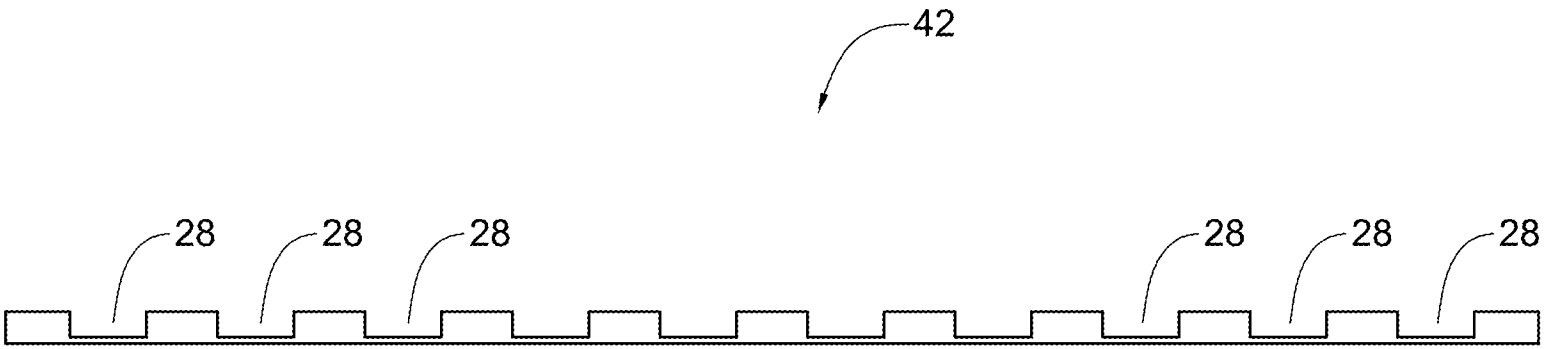
FIG. 19 is a side elevational view of the deck support panel of FIG. 17.
Figure 20:
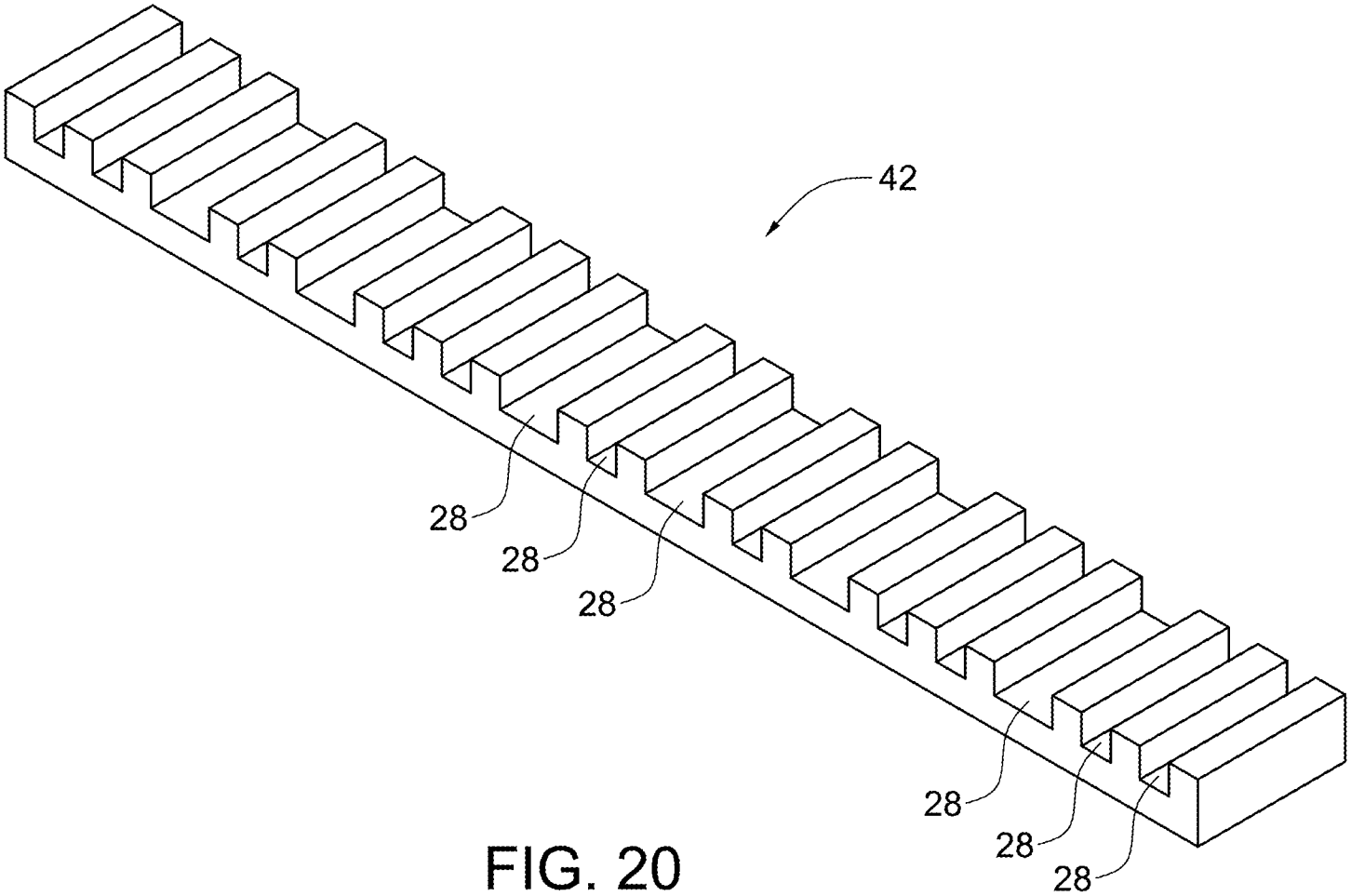
FIG. 20 is a top isometric view of another embodiment of a deck support panel comprising channels with irregular spacing.
Figure 21:
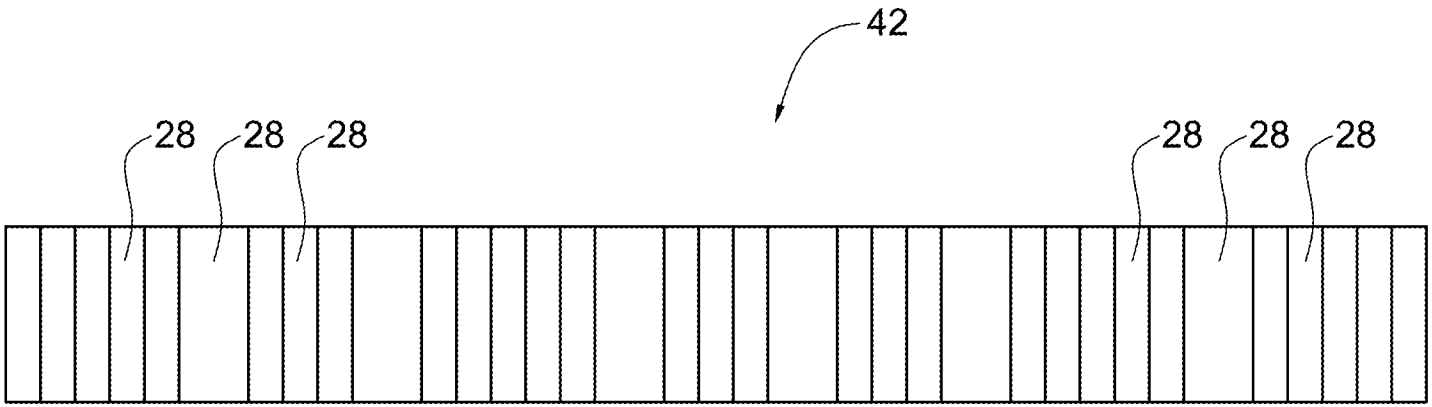
FIG. 21 is a top plan view of the deck support panel of FIG. 20.
Figure 22:
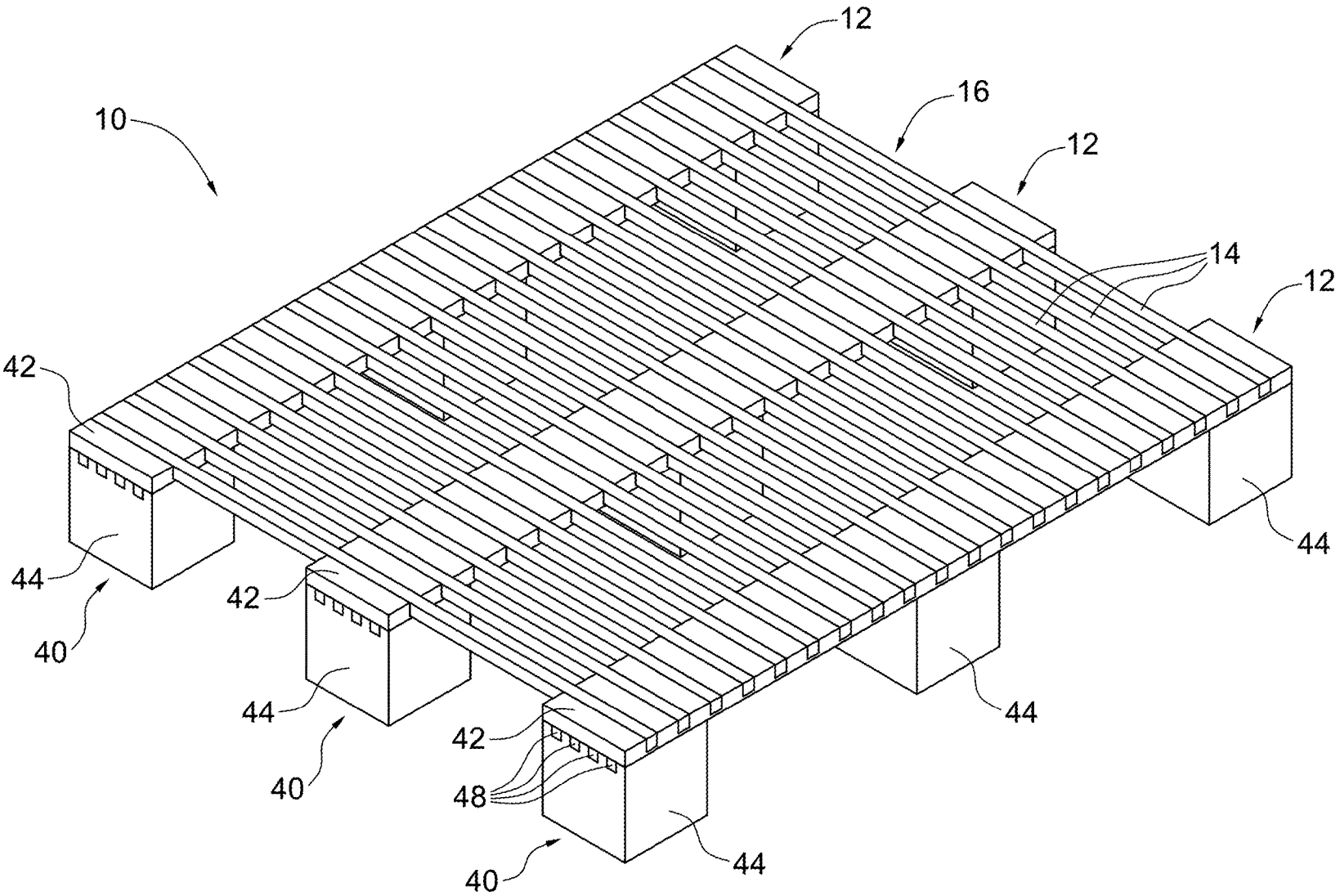
FIG. 22 is a top isometric view of an embodiment of an assembled pallet configured as a block pallet.

In some embodiments a deck support panel 42 may be positioned on each block pallet subassembly 40 (e.g. FIG. 22). Each deck panel 42 serves essentially the same function as an upper or lower portion of stringer 20 comprising spaced-apart channels 28 as described above (e.g. FIG. 5). Similar to the embodiment of FIGS. 1-9, the sizing and spacing of channels 28 may vary in different embodiments. For example, the size of each channel 28 may vary depending upon the number and configuration of deck members 14 desired. FIGS. 17-19 illustrate an embodiment of deck panel 42 comprising a smaller number of larger channels 28 than the embodiment of FIGS. 14-16. FIGS. 20-21 illustrate an embodiment wherein the spacing between channels 28 and hence deck members 14 is variable. As explained above, variable spacing of deck members 14 enables, for example, a larger number of deck members 14 toward end portions of pallet 10 and a lesser number of deck members 14 in central or intermediate portions of pallet 10. As will be appreciated by a person skilled in the art, the number, size, orientation and spacing of deck members 14 may vary as described above so that the load-supporting surface area of upper deck surface 16 is significantly less than a conventional pallet. In some embodiments the number, size and spacing of stringer members 48 may also vary in a similar manner. Thus in both stringer and block pallet configurations frame members 12 (e.g. comprising stringer members 48) and deck members 14 may vary to reduce the overall weight and cost of manufacture and assembly of pallet 10. In some particular embodiments the size and shape of deck support panels 42 and blocks 44 may vary for varying the size of frame members 12.

Each deck support panel 42 may be connectable to an upper portion of a respective block pallet subassembly 40 to form a portion of upper deck surface 16 or may be connectable to a lower portion of a respective block pallet subassembly 40 to form a portion of lower deck surface 18. Each deck support panel 42 is connectable to a corresponding block pallet subassembly 40 by any suitable means, such as heat welding or adhesives. In some embodiments each deck support panel 42 may serve a dual function to support deck members 14 and also to couple blocks 44 together. That is, each deck support panel 42 may be connected directly to blocks 44 (e.g. FIG. 27) rather than to an underlying block connector 46 in such embodiments. In some embodiments each deck support panel 42 may comprise an integrated portion of block pallet subassembly 40 defining an upper and/or lower portion of a frame member 12.

Figure 26:
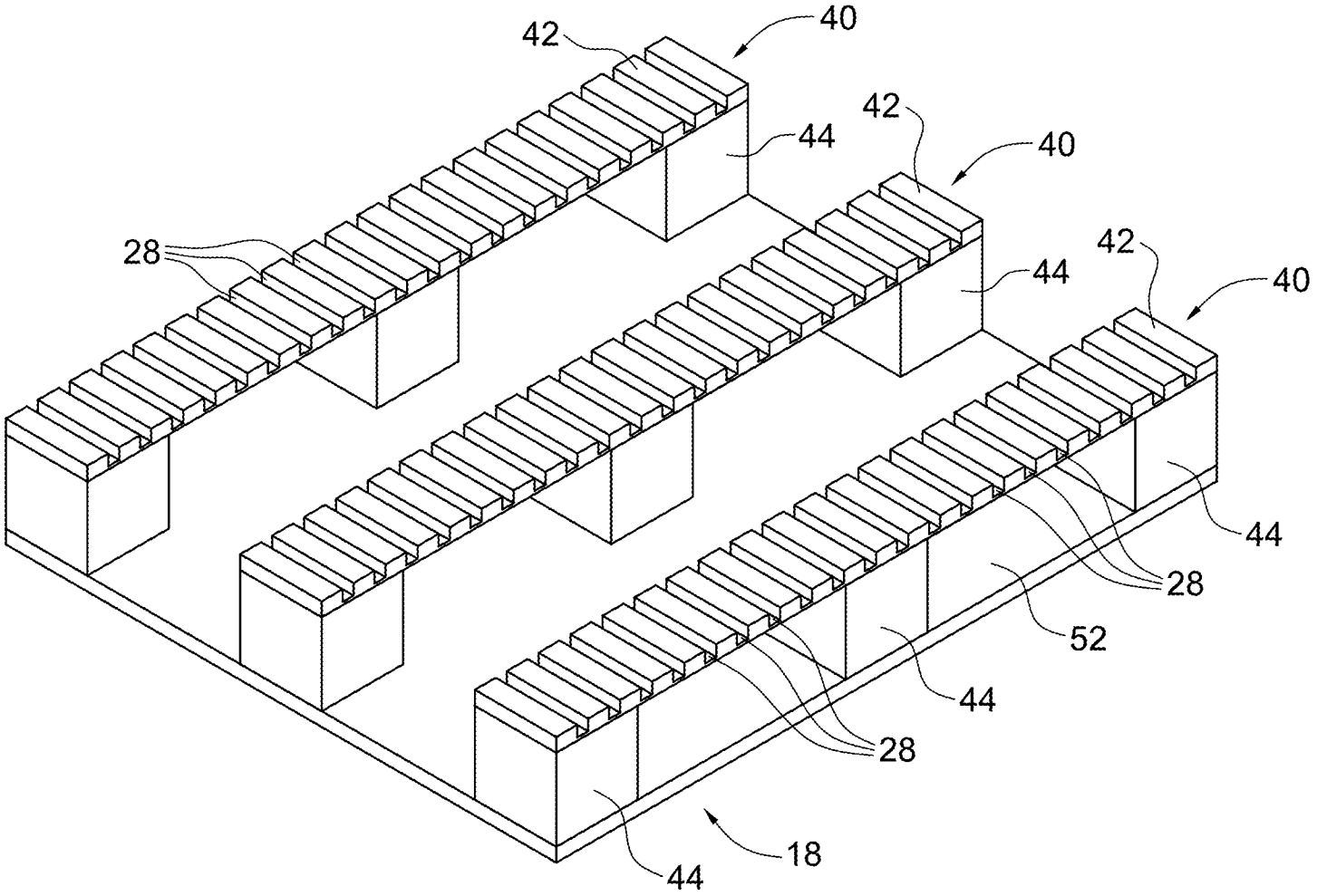
FIG. 26 is a top isometric view of a partially assembled pallet comprising a plurality of block pallet subassemblies and deck support panels.
Figure 27:
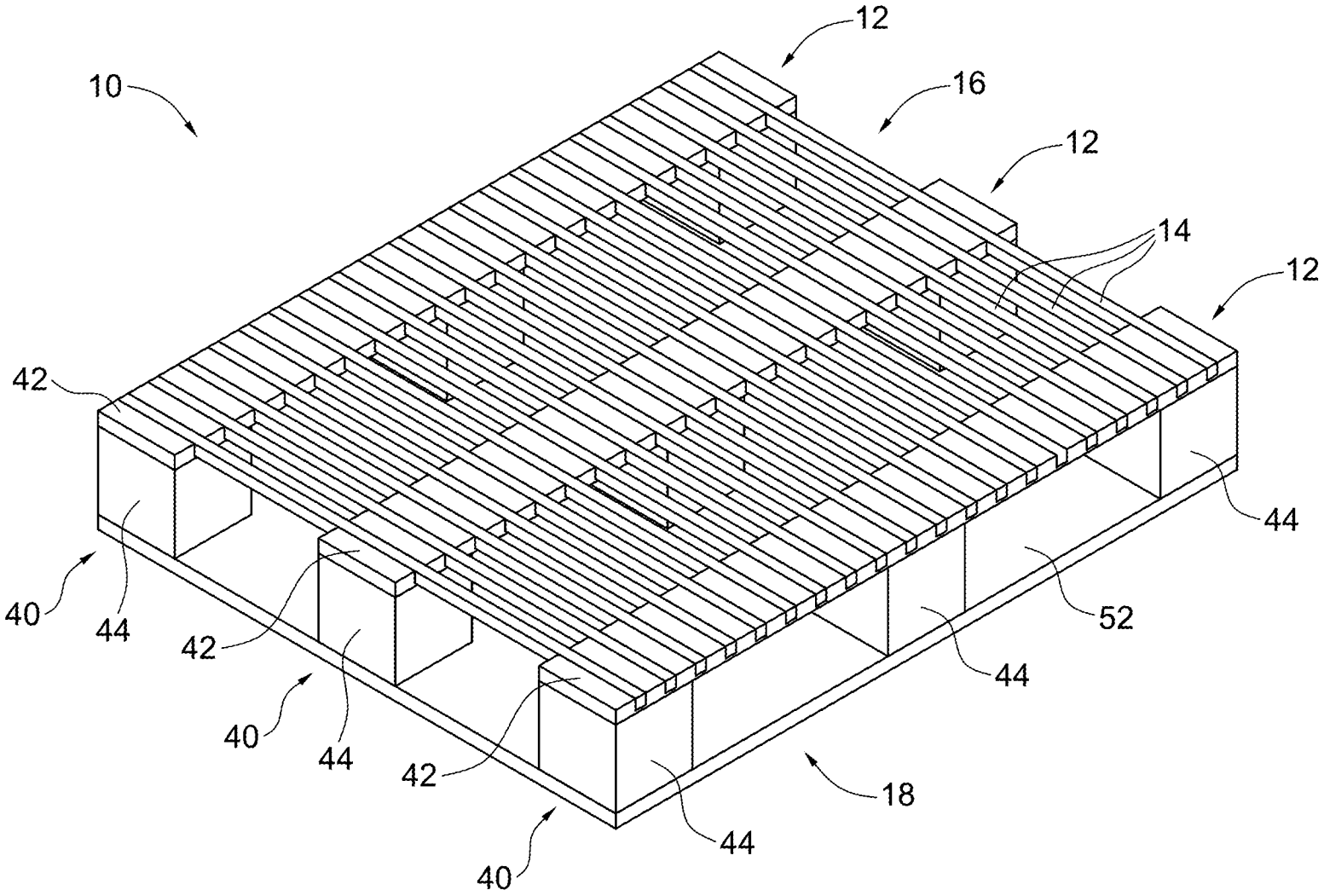
FIG. 27 is a top isometric view of a fully assembled embodiment of a pallet configured as a block pallet.

FIGS. 26-27 illustrate an embodiment where lower portions of a plurality of block pallet subassemblies 40 are coupled together with a unitary panel 52 forming a continuous lower deck surface 18. In this embodiment upper deck surface 16 is formed from a plurality of deck members 14 positionable on deck support panels 42 as described above.

Figure 28:
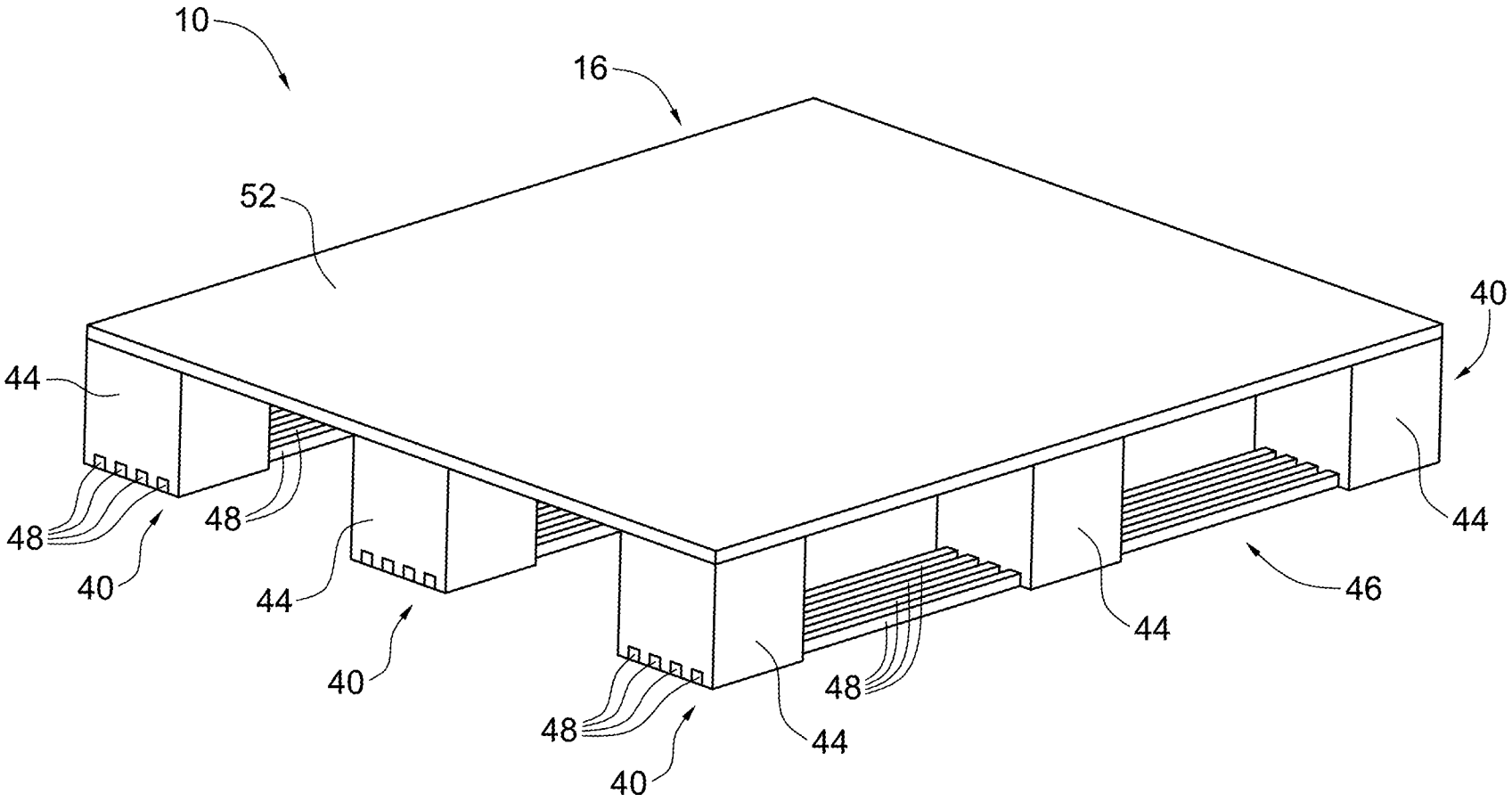
FIG. 28 is a top isometric view of a further embodiment of an assembled pallet configured as a block pallet and having a continuous upper deck surface.

FIG. 28 illustrates an embodiment where a unitary panel 52 is placed on a plurality of block pallet subassemblies 40 to form an upper deck surface 16. In this embodiment deck support panels 42 and separate deck members 14 could be omitted.

Figure 29:
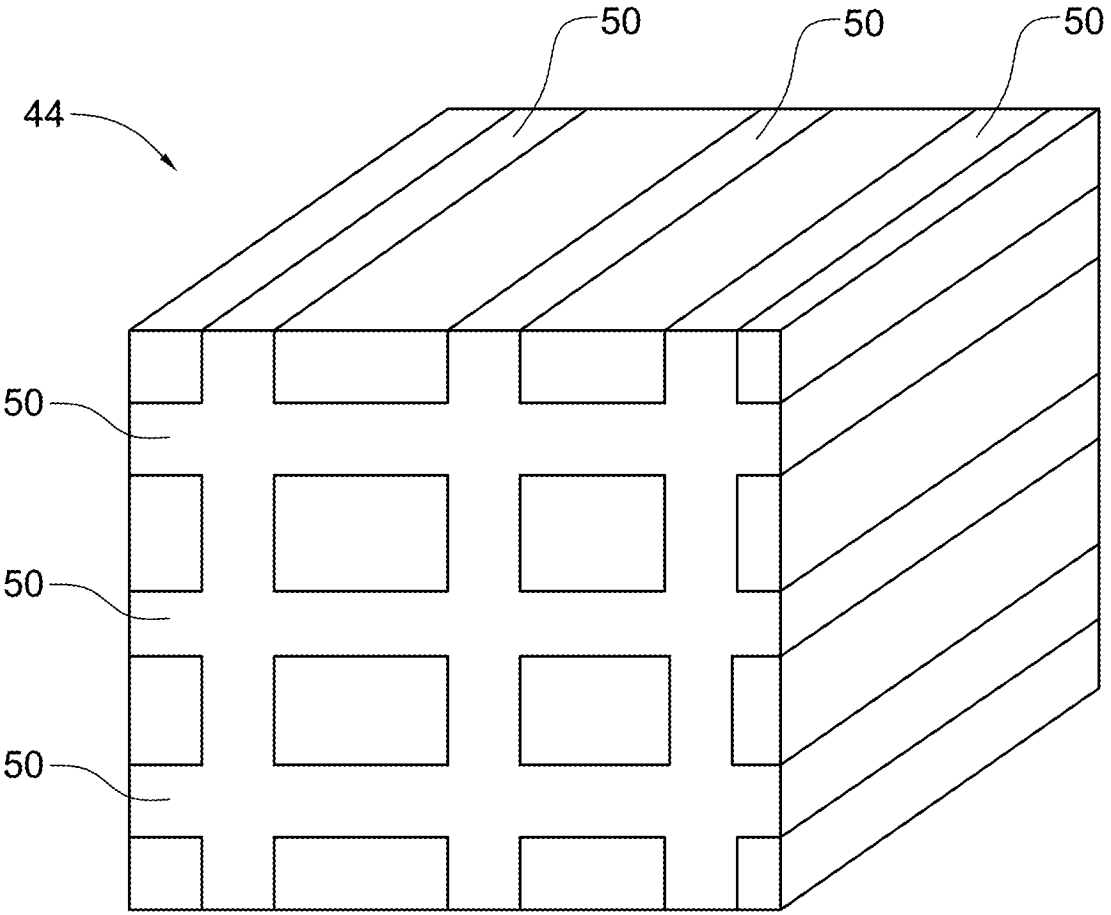
FIG. 29 is a top isometric view of a slotted block for use in a block pallet.

As described above, in some embodiments slots 50 formed in blocks 44 could be formed in one surface of block 44 (FIG. 25) or a pair of opposed surfaces (FIG. 13). As will be apparent to a person skilled in the art, in other embodiments slots 50 could be formed in additional surfaces of block 44, such as two pairs or three pairs of opposed surfaces (FIG. 29). In some such embodiments slots 50 could be intersecting or overlapping. In some such embodiments stringer members 48 could extend from a block 44 in multiple different directions, for example to couple a selected block 44 to more than one other block 44. In some such embodiments stringer members 48 could at least partially function as deck members 14. As will be appreciated by a person skilled in the art, the various modular components of pallet 10 could be assembled in different configurations depending upon the particular finished article desired.

In use, modular pallet 10 of the embodiments of FIGS. 10-29 may be constructed from an assembly of separate component parts in a manner similar to the embodiment of FIGS. 1-9. In particular, pallet 10 may be constructed by assembling a plurality of block pallet subassemblies 40 from a plurality of blocks 44 and block connectors 46. In further particular, in some embodiments a plurality of stringer members 48 may be placed in block slots 50 to form block connectors 46. The block pallet subassemblies 40 could then be arranged in parallel, spaced-apart relation as shown in FIG. 23. A deck support member 42 may then be placed on each block pallet subassembly 40 to form assembled frame members 12. Upper deck surface 16 could then be formed by connecting frame members 12 together with deck members 14, namely by placing each deck member 14 within a subgroup of aligned channels 28 in deck support panels 42 (FIGS. 22 and 26-27). That is, in this example each deck member 14 is inserted into a channel 28 of each one of deck support panels 42 to couple frame members 12 together (FIG. 22) Deck members 14 are sized and configured to fit snugly within channels 28 as described above. During or after assembly the various component parts of modular pallet 10 could be integrally connected together by heat welding, by using adhesive, or by some other suitable method.

As described above, in other embodiments a plurality of block pallet subassemblies 40 could be used in association with continuous panels 52 or other modular pallet structures.

In some embodiments pallet 10 may be shipped to an assembly site in a disassembled state, e.g. with deck members 14 and stringers 20 packaged as separate pieces of a kit; and/or deck members 14, deck support panels 42, blocks 44 and stringer members 48 packaged as separate pieces of a kit. This enables the component parts of modular pallet 10 to be shipped more compactly and economically than unitary or pre-assembled pallets 10. At the assembly site, which could be at or close to the site of use, pallets 10 could then be easily assembled as described above. In some embodiments deck members 14 and stringer members 48 could be the same shape and diameter and could be cut to size as necessary at the assembly site.

As indicated above, in some embodiments pallet 10 is constructed from plastic. For example deck members 14, stringers 20, deck support panels 42, blocks 44 and/or stringer members 48 could be constructed by means of plastic injection moulding, pressure moulding or extrusion.

As discussed above, plastic pallets 10 may have a considerably longer useful life than conventional wood pallets. After use, the component parts of pallet 10 may be recycled. Pallet 10 may be constructed from readily recyclable plastic. Examples of readily recyclable plastics include polyethylene terephthalate (PET), high density polyethylene (HDPE), polyvinyl chloride (PVC), low density polyethylene (LDPE), polypropylene (PP), and polystyrene (PS). In some embodiments pallets 10 may be constructed from combinations or mixtures of different compatible plastics.

In some embodiments pallet 10 may be constructed from doped plastic. By way of example the plastic may be doped with materials such as wood flour, chalk, talc, clay, ground-up coconut husks, carbon fibres, metal fibres and calcium carbonate. The plastic used to construct pallet 10 may also include additives to alter or enhance the colour, fragrance, fire retardation or other qualities of pallet 10.

While a number of exemplary aspects and embodiments have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are consistent with the broadest interpretation of the specification as a whole.

What is claimed is:

1. A modular pallet comprising:

(a) a plurality of elongated frame members arranged in spaced-apart relation, wherein each of said frame members comprises an upper surface and a lower surface and wherein each of said upper surface and said lower surface has a plurality of spaced-apart channels formed therein; and (b) a plurality of elongated deck members positionable in said channels for coupling said frame members together, wherein each of said deck members is integrally fused to at least some of said frame members when said modular pallet is assembled.

2. The pallet as defined in claim 1, wherein each of said frame members has a longitudinal axis extending along a length thereof and wherein each of said channels extends transversely substantially perpendicular to said longitudinal axis.

3. The pallet as defined in claim 2, wherein said frame members are arranged in parallel relation and wherein each of said deck members extends transversely in a direction substantially perpendicular to said longitudinal axis.

4. The pallet as defined in claim 3, wherein each of said deck members is positionable within an aligned subgroup of said channels formed in corresponding ones of said frame members.

5. The pallet as defined in claim 1, wherein said frame members and said deck members are formed from plastic.

6. The pallet as defined in claim 5, wherein the entirety of said pallet is formed from recyclable plastic.

7. The pallet as defined in claim 6, wherein said plastic is selected from the group consisting of polyethylene, polypropylene, polystyrene and polyvinylchloride.

8. The pallet as defined in claim 5, wherein said pallet comprises doped plastic.

9. The pallet as defined in claim 8, wherein said plastic is doped with materials selected from the group consisting of wood flour, chalk, talc, clay, ground-up coconut husks, carbon fibres, metal fibres and calcium carbonate.

10. The pallet as defined in claim 1, wherein each of said frame members is a stringer of unitary construction.

11. The pallet as defined in claim 10, wherein said lower surface of each of said stringers has spaced-apart openings formed therein, each of said openings being sized to accommodate a forklift fork or ground lift.

12. The pallet as defined in 1, wherein each of said channels is rectangular in shape.

13. The pallet as defined in claim 12, wherein each of said deck members is rectangular in cross-section.

14. The pallet as defined in claim 1, wherein each of said channels is between about ¼ inch and about 10 inches in width.

15. The pallet as defined in claim 14, wherein each of said channels is less than about 4 inches in width.

16. The pallet as defined in claim 15, wherein each of said channels is between about ⅝ inch and about 1 inch in width.

17. The pallet as defined in 1, wherein each of said deck members positioned in said channels formed in said upper surface of each of said frame members has an outer surface extending co-planar with said upper surface thereby forming part of a planar upper deck surface of said pallet.

18. The pallet as defined in claim 1, wherein each of said deck members positioned in said channels formed in said lower surface of each of said frame members has an outer surface extending co-planar with said lower surface thereby forming part of a planar lower deck surface of said pallet.

19. The pallet as defined in claim 1, wherein the width of said plurality of channels, and the corresponding width of said deck members, is uniform.

20. The pallet as defined in claim 1, wherein the spacing between said channels formed in each of said frame members is non-uniform.

21. The pallet as defined in claim 20, wherein each of said frame members comprises a first portion comprising a first plurality of channels having a first spacing therebetween and a second portion comprising a second plurality of channels having a second spacing therebetween, wherein said second spacing is greater than said first spacing.

22. The pallet as defined in claim 21, wherein said first portion is located at an end portion of each of said frame members.

23. The pallet as defined in claim 22, wherein said second portion is located in an intermediate section of each of said frame members between end portions thereof.

24. The pallet as defined in 23, wherein said first portion comprises four or more channels.

25. The pallet as defined in claim 24, wherein said four or more channels in said first portion are equally spaced-apart.

26. The pallet as defined in claim 1, wherein said pallet has a weight less than about 50 lbs.

27. The pallet as defined in claim 26, wherein said pallet has a weight less than about 25 lbs.

28. The pallet as defined in claim 27, wherein said pallet has a weight less than about 20 lbs.

29. The pallet as defined in claim 1, wherein said pallet has a deck surface area for supporting a load defined by the multiple of a length of one of said frame members and a length of one of said deck members, wherein said deck members are spaced within said channels such that said deck members comprise less than about 60% of said deck surface area.

30. The pallet as defined in claim 29, wherein said deck members comprise less than about 50% of said deck surface area.

31. The pallet as defined in claim 30, wherein said deck members comprise less than about 35% of said deck surface area.

32. The pallet as defined in claim 31, wherein said pallet has a static load bearing capacity of at least 1000 pounds.

33. The pallet as defined in claim 1, wherein said frame members are coupled together solely by said deck members.

34. The pallet as defined in claim 1, wherein each of said channels comprises a planar inner surface for receiving a corresponding planar surface of one of said deck members.

35. The pallet as defined in claim 34, wherein said inner surface and said corresponding surface are integrally fused when said pallet is assembled.

36. The pallet as defined in claim 1, wherein each of said deck members comprise a first pair of opposed first outer surfaces and a second pair of opposed second outer surfaces, wherein each of said first outer surfaces and each of said second outer surfaces is substantially planar.

37. The pallet as defined in claim 1, wherein each of said channels receives a deck member and wherein the spacing between said channels is non-uniform.

38. A kit for forming a pallet comprising:

(a) a plurality of elongated frame members positionable in spaced-apart relation, each comprising an upper surface and a lower surface, wherein each of said upper surface and said lower surface has a plurality of spaced-apart channels formed therein; and (b) a plurality of elongated deck members positionable within said channels for coupling said frame members together without mechanical connectors, wherein each of said deck members has a uniform width, is rectangular in cross-section and comprises a first planar surface and a second planar surface opposite said first planar surface, wherein said frame members and said deck members are formed from plastic and are adapted to be integrally fused together when said pallet is formed.

39. The kit as defined in claim 38, wherein each of said frame members has a longitudinal axis extending along a length thereof and wherein each of said channels extends transversely substantially perpendicular to said longitudinal axis.

40. The kit as defined in claim 38, wherein each of said frame members is a stringer of unitary construction.

41. A modular pallet comprising:

(a) a plurality of elongated frame members arranged in spaced-apart relation, wherein each of said frame members comprises an upper surface, a lower surface, and a plurality of spaced-apart channels formed in at least said upper surface; and (b) a plurality of elongated deck members positionable in said channels for extending between said frame members to form an upper deck of said pallet, wherein each of said deck members is integrally fused to at least some of said frame members when said modular pallet is assembled.

42. The pallet as defined in claim 41, wherein said upper deck has a deck surface area for receiving a load and wherein said deck members are spaced within said channels such that said deck members comprise less than about 60% of said deck surface area.

43. The pallet as defined in claim 42, wherein said deck members comprise less than about 50% of said deck surface area.

44. The pallet as defined in claim 43, wherein said deck members comprise less than about 35% of said deck surface area.

45. The pallet as defined in claim 42, wherein the spacing between said channels formed in each of said frame members is non-uniform.

46. A modular pallet comprising:

(a) a plurality of elongated frame members arranged in spaced-apart relation, wherein each of said frame members comprises an upper surface and a lower surface and wherein at least said upper surface has a plurality of spaced-apart channels formed therein; and (b) a plurality of elongated deck members positionable in said channels for coupling said frame members together, wherein each of said channels receives one of said deck members when said pallet is assembled, wherein said pallet has a deck surface area for supporting a load defined by the multiple of a length of one of said frame members and a length of one of said deck members, wherein said deck members are spaced within said channels such that upper surfaces of said frame members and said deck members comprise less than about 50% of said deck surface area, wherein each of said deck members being substantially square in cross-section and comprising first, second, third and fourth outer surfaces, wherein each of said channels comprises a planar inner surface and wherein each of said deck members is snugly positionable within a corresponding one of said channels in an orientation wherein any one of said outer surfaces of said deck members contacts said inner surface of said channel.

47. A modular pallet comprising:

(a) a plurality of elongated frame members arranged in spaced-apart relation, wherein each of said frame members comprises an upper surface and a lower surface and wherein each of said upper surface and said lower surface has a plurality of spaced-apart channels formed therein; and (b) a plurality of elongated deck members positionable in said channels for coupling said frame members together, wherein each of said deck members has a first planar surface and a second planar surface opposite said first planar surface, wherein each of said deck members is positionable in said channels formed in said frame members in either a first configuration wherein said first surface extends outwardly co-planar with said upper surface of said frame members thereby forming part of a planar upper deck surface of said pallet or in a second configuration wherein said second surface extends outwardly co-planar with said upper surface of said frame members thereby forming part of a planar upper deck surface of said pallet;

wherein each of said deck members is integrally fused to at least some of said frame members when said modular pallet is assembled, and wherein said pallet has a deck surface area for supporting a load defined by the multiple of a length of one of said frame members and length of one of said deck members, wherein said deck members are spaced within said channels such that upper surfaces of said frame members and said deck members comprise less than about 50% of said deck surface area.

48. The pallet as defined in claim 47, wherein the shape of each said channels and each of said frame members is rectangular in cross-section.

49. The pallet as defined in claim 47, wherein a width of each of said deck members is less than a width of each of said frame members.

50. The pallet as defined in claim 47, wherein the number of said deck members forming part of said planar upper deck surface exceeds 10.

51. The pallet as defined in claim 47, wherein each of said channels receives one of said deck members when said pallet is assembled.

52. The pallet as defined in claim 51, wherein the spacing between said channels formed in each of said frame members is non-uniform.

53. A modular pallet comprising:

(a) a plurality of elongated frame members arranged in spaced-apart relation, wherein each of said frame members comprises an upper surface and a lower surface and wherein each of said upper surface and said lower surface has a plurality of spaced-apart channels formed therein; and (b) a plurality of elongated deck members positionable in said channels for coupling said frame members together, wherein each of said deck members has a first planar surface and a second planar surface opposite said first planar surface, wherein each of said deck members is positionable in said channels formed in said frame members in either a first configuration wherein said first surface extends outwardly co-planar with said upper surface of said frame members thereby forming part of a planar upper deck surface of said pallet or in a second configuration wherein said second surface extends outwardly co-planar with said upper surface of said frame members thereby forming part of a planar upper deck surface of said pallet; and wherein said pallet has a deck surface area for supporting a load defined by the multiple of a length of one of said frame members and length of one of said deck members, wherein said deck members are spaced within said channels such that upper surfaces of said frame members and said deck members comprise less than about 50% of said deck surface area wherein said frame members and said deck members are formed from plastic and wherein each of said deck members is integrally fused to at least some of said frame members when said modular pallet is assembled.

* * * * *